US009922484B2

(12) United States Patent
Shibata et al.

(10) Patent No.: US 9,922,484 B2
(45) Date of Patent: Mar. 20, 2018

(54) COIN PROCESSING APPARATUS

(71) Applicant: FUJI ELECTRIC CO., LTD., Kawasaki-shi, Kanagawa (JP)

(72) Inventors: Yoshito Shibata, Tsu (JP); Katsuya Nakajima, Nagano (JP); Takao Okuhara, Yokkaichi (JP); Takuya Fukuura, Yokkaichi (JP); Norio Nakajima, Yokkaichi (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 0 days.

(21) Appl. No.: 15/363,664

(22) Filed: Nov. 29, 2016

(65) Prior Publication Data

US 2017/0154486 A1 Jun. 1, 2017

(30) Foreign Application Priority Data

Dec. 1, 2015 (JP) ..... 2015-234952
Dec. 1, 2015 (JP) ..... 2015-234953

(51) Int. Cl.
*G07D 1/00* (2006.01)
*G07D 3/12* (2006.01)

(52) U.S. Cl.
CPC ..... *G07D 3/121* (2013.01); *G07D 1/00* (2013.01)

(58) Field of Classification Search
CPC ..... G07D 1/00; G07D 3/121
See application file for complete search history.

(56) References Cited

U.S. PATENT DOCUMENTS 3,381,694 A * 5/1968 Lempke ..... G07D 9/00 221/116
6,003,652 A * 12/1999 Murata ..... G07D 1/00 194/206
6,071,187 A * 6/2000 Knutsson ..... G07D 9/00 209/286

FOREIGN PATENT DOCUMENTS

JP 2011-039773 A 2/2011

* cited by examiner

*Primary Examiner* — Mark J Beauchaine
(74) *Attorney, Agent, or Firm* — Manabu Kanesaka

(57) ABSTRACT

In a coin processing apparatus including a plurality of coin containers, each of the coin containers includes a housing guide and a screw-type conveyance member. The housing guide has both side sections paired in a left-right direction. The housing guide has lateral protrusions formed on inner surfaces of the paired side sections and protruding to extend close to each other. The screw-type conveyance member has a shaft having a cylindrical shape and a blade member spirally provided on an outer periphery of the shaft such that the blade member protrudes outward from the outer periphery, and is provided to the housing guide such that a part of the shaft and a part of the blade protrude upward in a space between the lateral protrusions and may rotate about a central axis of the shaft. The screw-type conveyance member is provided at an off-center position of the housing guide.

7 Claims, 17 Drawing Sheets

COIN PROCESSING APPARATUS

CROSS-REFERENCE TO RELATED APPLICATION(S)

The present application claims priority to and incorporates by reference the entire contents of Japanese Patent Application No. 2015-234953 filed in Japan on Dec. 1, 2015 and Japanese Patent Application No. 2015-234952 filed in Japan on Dec. 1, 2015.

BACKGROUND

The present disclosure relates to coin processing apparatuses.

In the related art, an example of the coin processing apparatuses applied to change machines identifies authenticity and a denomination of a coin dropped in a coin receiving opening, and thereafter, automatically takes in the coin identified as a true coin to house the coin in the corresponding one of the coin containers provided for respective denominations. The coin processing apparatus dispenses, as change, a requested amount of coins to a coin dispensing opening out of the coins housed in the coin containers in accordance with a change dispensing request from an external apparatus (e.g., refer to Japanese Patent No. 5375425).

In the coin processing apparatus, the coins are conveyed by a belt endlessly stretched between a pair of rollers in the coin container. The conveyance method causes a failure in conveyance such as a reduction in conveyance force due to a reduction in friction force caused by dirt coming from the conveyed coins or occurrence of inclined coins, which continue to stay at a constant position while rolling on the belt.

There is a need for a coin processing apparatus that may prevent the reduction in conveyance force and the occurrence of inclined coins, and successfully convey coins.

SUMMARY

It is an object of the present disclosure to at least partially solve the problems in the related art.

In some embodiments, a coin processing apparatus includes: a plurality of coin containers configured to house received coins for each denomination of the coins and dispense the coins in accordance with a coin output instruction, each of the coin containers including: a housing guide that includes: a case whose upper and lower portions are open, whose longitudinal direction is a front-rear direction, and whose both side sections are paired in a left-right direction; and lateral protrusions formed on inner surfaces of the paired side sections and protruding to extend close to each other; and a screw-type conveyance member that includes: a shaft having a cylindrical shape and extending along the front-rear direction; and a blade member spirally provided on an outer periphery of the shaft and protruding outward from the outer periphery, wherein the screw-type conveyance member is provided to the housing guide rotatably about a central axis of the shaft, and a part of the shaft and a part of the blade member protrude from a space between the lateral protrusions, and wherein the screw-type conveyance member is configured to gradually tilt backward as the blade member protruding upward from the space between the lateral protrusions proceeds from one direction to the other direction in the left-right direction, convey the coins housed in pitch intervals of the blade member above the protrusions forward by rotating about the central axis of the shaft from the one direction to the other direction in the left-right direction, and the screw-type conveyance member is provided at an off-center position such that the screw-type conveyance member is close to one side section in the left-right direction and apart from the other side section in the left-right direction of both side sections of the housing guide.

In some embodiments, a coin processing apparatus includes: A coin processing apparatus, comprising: a plurality of coin containers configured to house received coins for each denomination of the coins and dispense the coins in accordance with a coin output instruction, each of the coin containers including: a screw-type conveyance member that includes a shaft having a cylindrical shape; and a blade member spirally provided on an outer periphery of the shaft and protruding outward from the outer periphery, wherein the screw type-conveyance member conveys the coins by rotating about a central axis of the shaft; and a control unit configured to reduce a rotating speed of the screw-type conveyance member when the number of housed coins is less than a predetermined amount.

The above and other objects, features, advantages and technical and industrial significance of the present disclosure will be better understood by reading the following detailed description of presently preferred embodiments of the present disclosure, when considered in connection with the accompanying drawings.

DETAILED DESCRIPTION

The following describes a preferred embodiment of a coin processing apparatus according to the present disclosure in detail with reference to the accompanying drawings.

Figure 1:
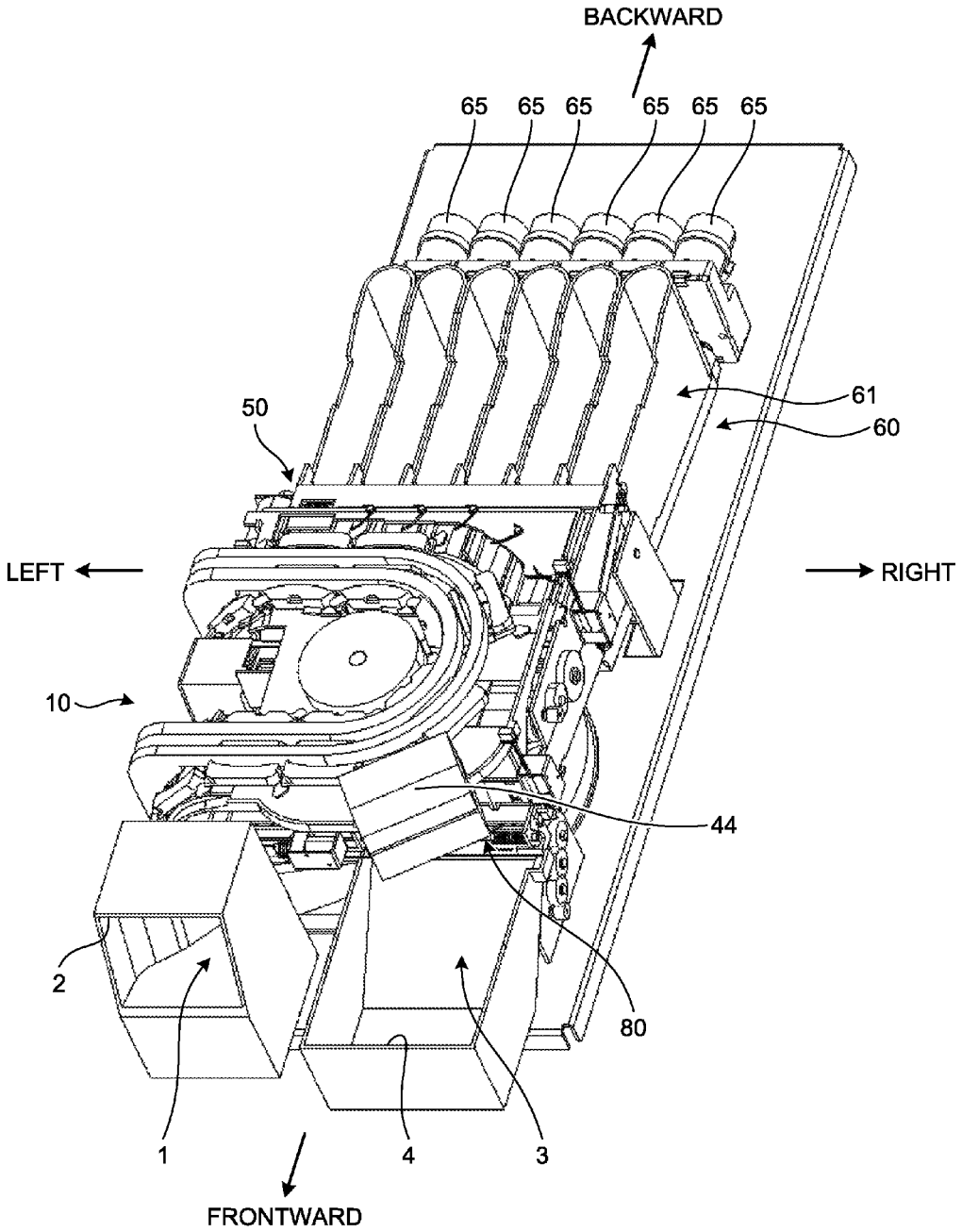
FIG. 1 is a perspective view illustrating an internal structure of a coin processing apparatus according to an embodiment of the present disclosure.
Figure 2:
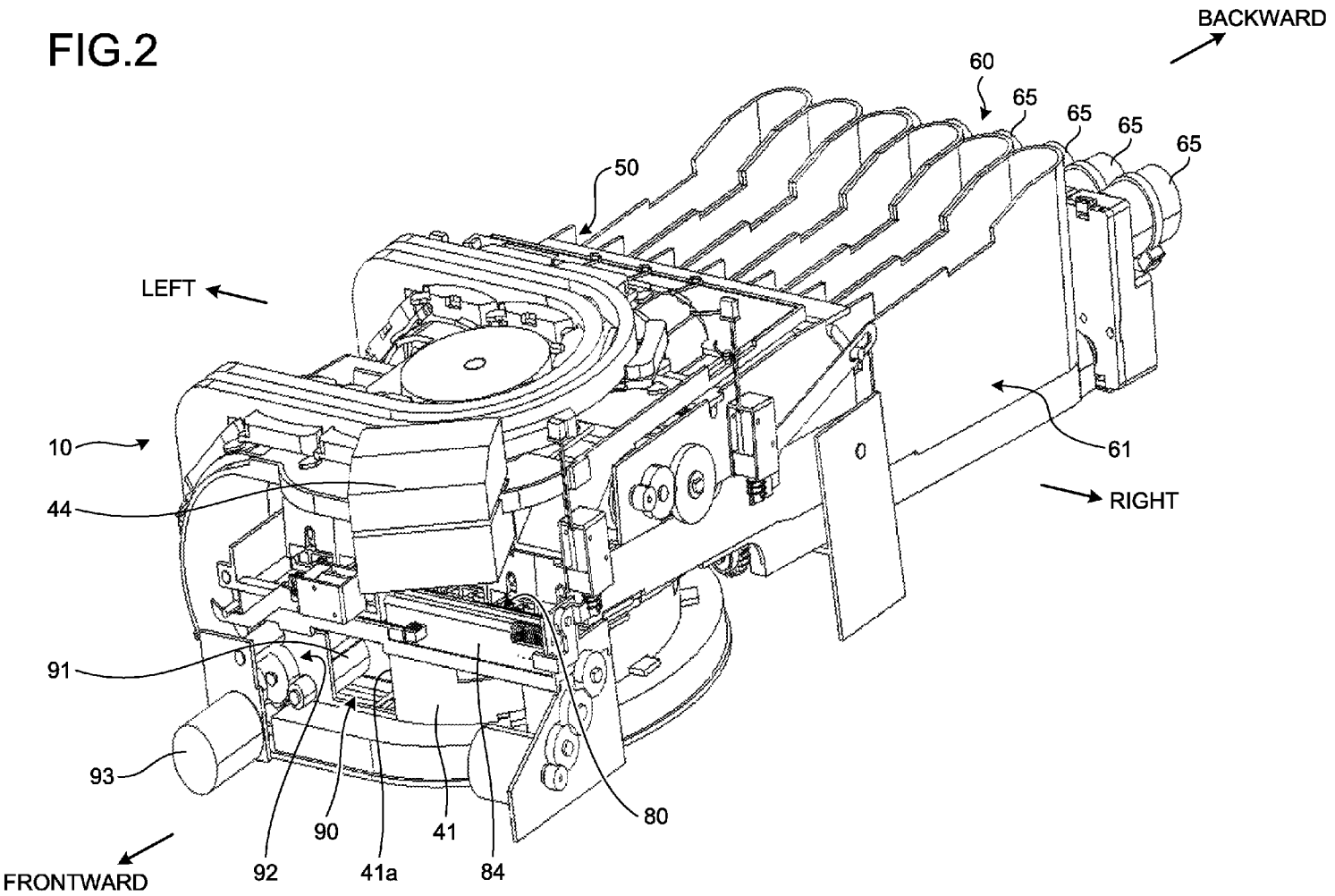
FIG. 2 is a perspective view illustrating the internal structure of the coin processing apparatus illustrated in FIG. 1 excluding some components thereof.

FIG. 1 is a perspective view illustrating an internal structure of the coin processing apparatus in the embodiment of the present disclosure. FIG. 2 is a perspective view illustrating the internal structure of the coin processing apparatus illustrated in FIG. 1 excluding some components thereof. The coin processing apparatus exemplified herein is applied to a change machine, for example. The coin processing apparatus includes a conveyance mechanism 10, a temporary storage unit 50, a housing unit 60, and a coin output suspending unit 80.

Figure 3:
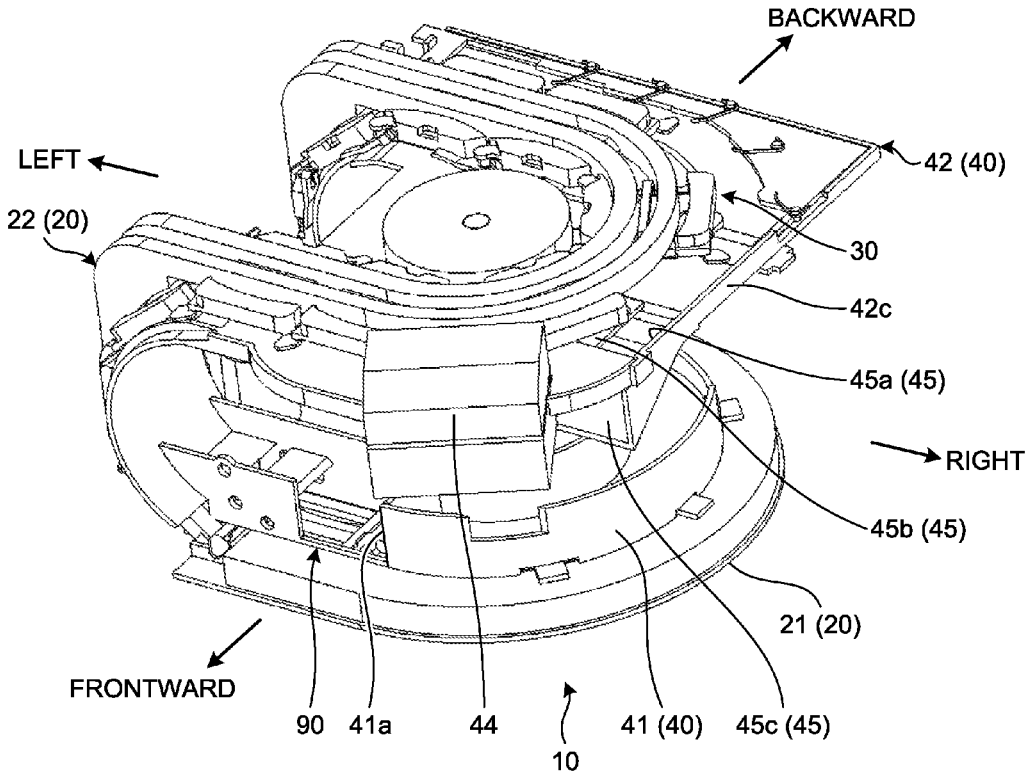
FIG. 3 is a perspective view illustrating a conveyance mechanism illustrated in FIGS. 1 and 2.
Figure 4:
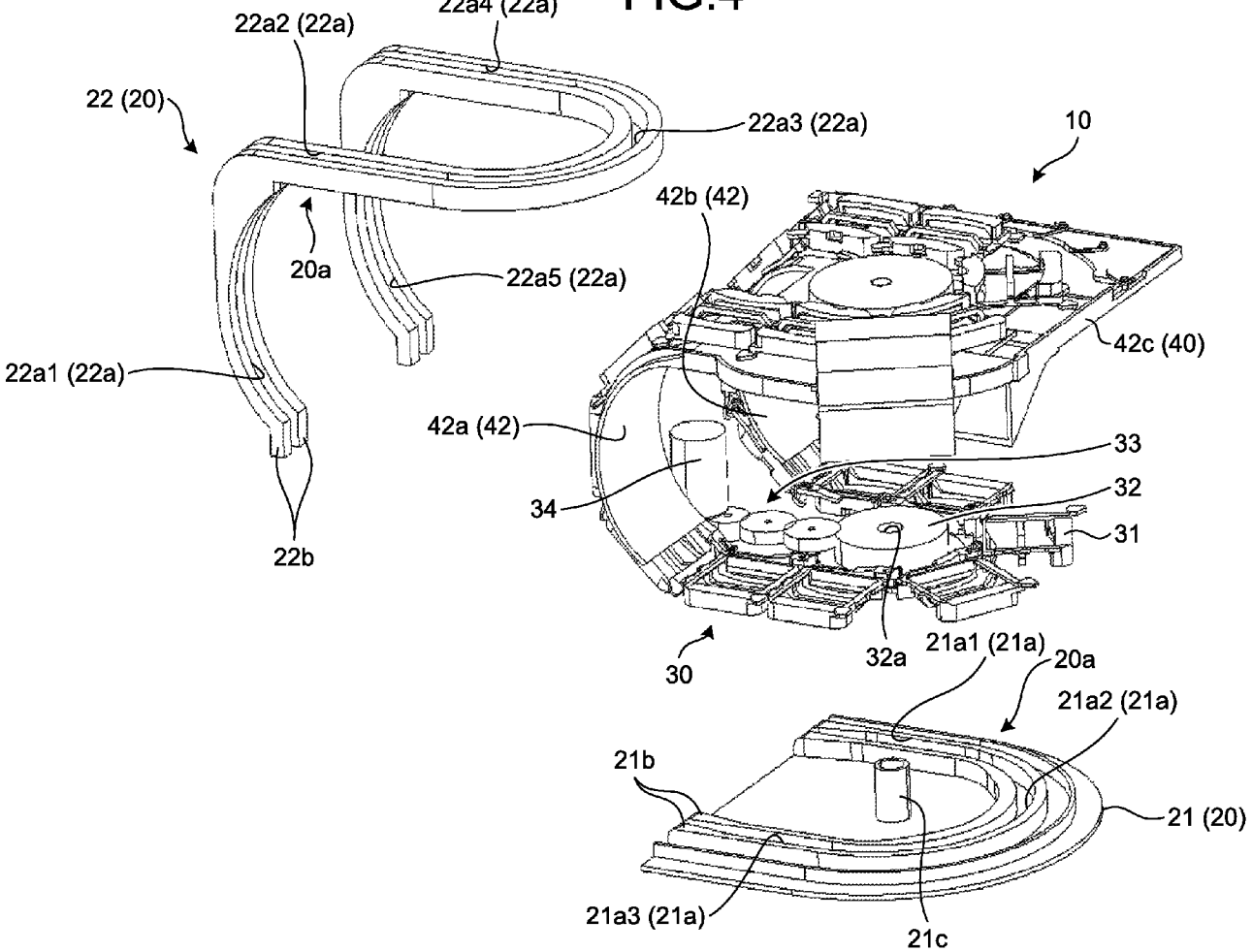
FIG. 4 is an exploded perspective view of a main part of the conveyance mechanism illustrated in FIGS. 1 and 2.

FIGS. 3 and 4 each illustrate the conveyance mechanism 10 illustrated in FIGS. 1 and 2. FIG. 3 is a perspective view thereof. FIG. 4 is an exploded perspective view of a main part thereof. As illustrated in FIGS. 3 and 4, the conveyance mechanism 10 includes a rail forming section 20, a conveyance section 30, and a conveyance base 40.

The rail forming section 20 includes a first rail forming member 21 and a second rail forming member 22. The first rail forming member 21 forms the bottom of the conveyance mechanism 10 and has a platy shape. On the upper surface of the first rail forming member 21, a first rail section 21*a* is formed. The first rail section 21*a* is shaped by a pair of long members 21*b* protruding upward. The first rail section 21*a* is, thus, provided between the pair of long members 21*b*.

The first rail section 21*a* is included in a conveyance path 20*a* for coins as a part of the conveyance path 20*a* for coins. The first rail section 21*a* is continuously composed of a first rail component 21*a*1 extending in the right direction, a second rail component 21*a*2 extending in an arc shape from the extending end of the first rail component 21*a*1 forward, and a third rail component 21*a*3 extending from the extending end of the second rail component 21*a*2 in the left direction.

The second rail forming member 22 has a second rail section 22*a*. The second rail section 22*a* is shaped by a pair of long members 22*b* in the same manner as the first rail section 21*a*. The second rail section 22*a* is included in the conveyance path 20*a* for coins as a part of the conveyance path 20*a* for coins. The second rail section 22*a* is, thus, provided between the pair of long members 22*b*. The second rail section 22*a* is continuously composed of a fourth rail component 22*a*1 extending upward in such an arc shape that the arc bulges in the left direction, a fifth rail component 22*a*2 extending in the right direction from the extending end of the fourth rail component 22*a*1, a sixth rail component 22*a*3 extending backward in an arc shape from the extending end of the fifth rail component 22*a*2, a seventh rail component 22*a*4 extending in the left direction from the extending end of the sixth rail component 22*a*3, and an eighth rail component 22*a*5 extending downward in such an arc shape that the arc bulges in the left direction from the extending end of the seventh rail component 22*a*4.

In the first rail forming member 21 and the second rail forming member 22, the first rail component 21*a*1 continues to the eighth rail component 22*a*5, and the third rail component 21*a*3 continues to the fourth rail component 22*a*1. As a result, the first rail section 21*a* and the second rail section 22*a* structure a single rail section. The rail section forms the conveyance path 20*a* used for conveying coins.

Figure 5:
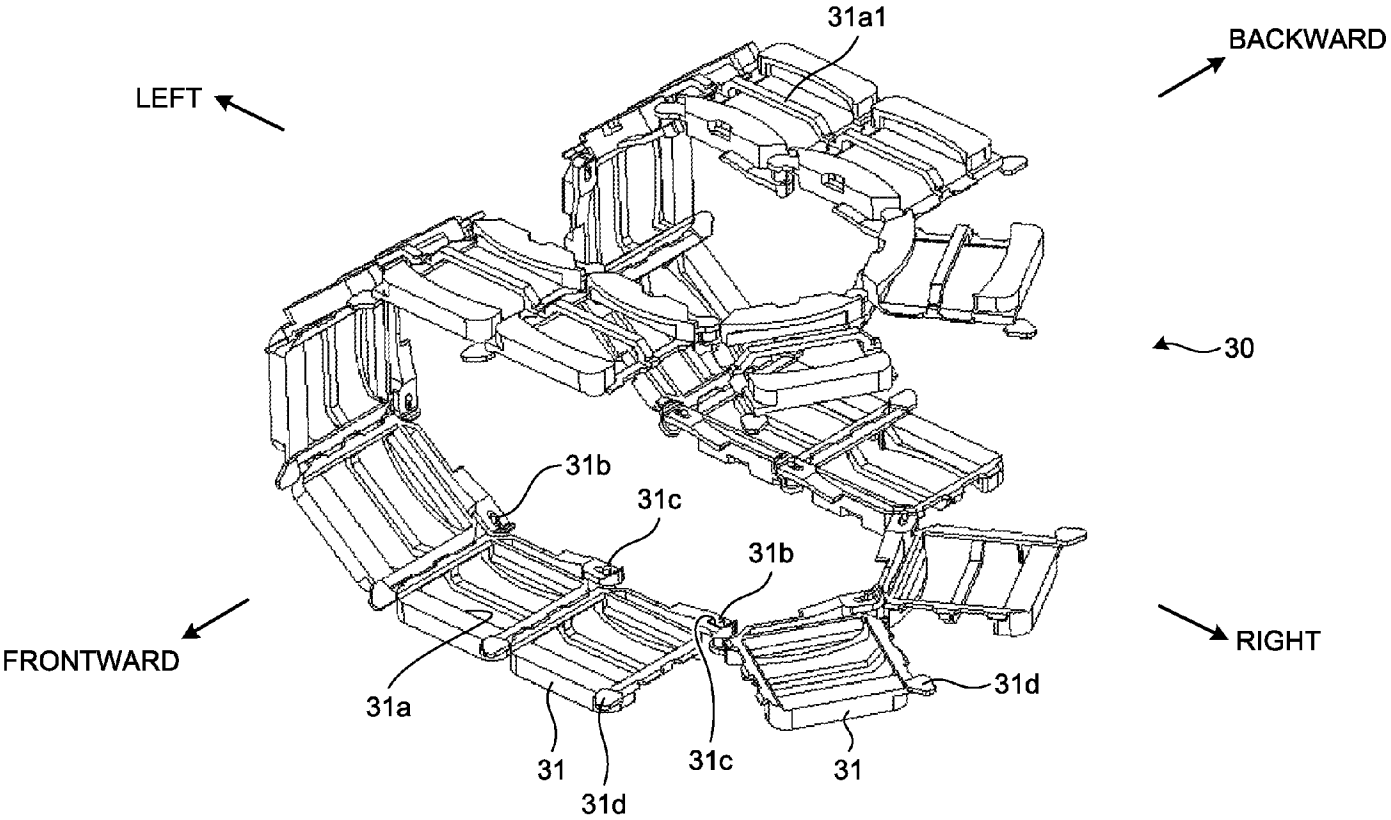
FIG. 5 is a perspective view illustrating a conveyance section included in the conveyance mechanism illustrated in FIGS. 1 to 4.

FIG. 5 is a perspective view illustrating the conveyance section 30 included in the conveyance mechanism 10 illustrated in FIGS. 1 to 4. As illustrated in FIG. 5, the conveyance section 30 has a plurality of holding sections 31. The holding section 31 has a housing recess 31*a* that houses a single coin. The holding section 31 has a connection protrusion 31*b* having a cylindrical shape at one end thereof and a connection hole 31*c* having a long hole shape at the other end thereof. The holding sections 31 are connected to one another in such a manner that the connection protrusion 31*b* of the holding section 31 is inserted through the connection hole 31*c* of the adjacent holding section 31.

As a result of placing long protrusions 31*a*1 included in the housing recesses 31*a* in the rail section (the first rail section 21*a* and the second rail section 22*a*) such that the long protrusions 31*a*1 may be guided, the holding sections 31 are endlessly connected to one another along the conveyance path 20*a* to structure the conveyance section 30.

The conveyance section 30 is composed of the multiple holding sections 31 endlessly connected to one another along the conveyance path 20*a*, and is capable of being displaced along the conveyance path 20*a*. In the conveyance section 30, the connection protrusion 31*b* and the connection hole 31*c*, which connect the adjacent holding sections 31, are provided on an inner side. At one end on an outer side of each holding section 31, a pushing protrusion (protrusion) 31*d* protruding outward is formed.

In the conveyance section 30, the long protrusions 31*a*1 are placed in the rail section such that they may be guided, as described above. As a result, the housing recess 31*a* faces upward in each of the holding sections 31 having the long protrusions 31*a*1 placed in the first rail component 21*a*1, the second rail component 21*a*2, and the third rail component 21*a*3. The housing recess 31*a* faces the right direction in each of the holding sections 31 having the long protrusions 31*a*1 placed in the fourth rail component 22*a*1 and the eighth rail component 22*a*5. The housing recess 31*a* faces downward in each of the holding sections 31 having the long protrusions 31*a*1 placed in the fifth rail component 22*a*2, the sixth rail component 22*a*3, and the seventh rail component 22*a*4.

In the conveyance section 30, the holding sections 31 having the long protrusions 31*a*1 placed in a part of the first rail component 21*a*1 and a part of the third rail component 21*a*3, and the holding sections 31 having the long protrusions 31*a*1 placed in the second rail component 21*a*2 engage with a part of the outer periphery of a conveyance transmission section 32 having a disc shape. The conveyance transmission section 32 has a through hole 32*a* formed at the central portion thereof. On the first rail forming member 21, a conveyance shaft 21*c* is formed such that the conveyance shaft 21*c* protrudes upward. The conveyance shaft 21*c* passes through the through hole 32*a*, thereby making it possible for the conveyance transmission section 32 to rotate about the central axis of the conveyance shaft 21*c*.

The conveyance transmission section 32 is coupled to a conveyance motor 34 with a connection member 33 interposed therebetween. When the conveyance motor 34 is driven by a command given from a control unit 100 (refer to FIG. 15), the conveyance transmission section 32 rotates about the central axis of the conveyance shaft 21*c* in a clockwise direction viewed from above.

As a result, the conveyance section 30 is displaced in the following order: the first rail component 21*a*1, the second rail component 21*a*2, the third rail component 21*a*3, the fourth rail component 22*a*1, the fifth rail component 22*a*2, the sixth rail component 22*a*3, the seventh rail component 22*a*4, and the eighth rail component 22*a*5.

The conveyance base 40 includes a lower base member 41 and an upper base member 42. The lower base member 41 is provided such that the lower base member 41 faces the first rail forming member 21 in which a part of the conveyance section 30 is placed. On the forward side of the lower base member 41, a notch 41*a* is formed to provide an input section 90.

The input section 90 communicates with a coin receiving opening 2 via a coin receiving guide 1. The input section 90 stores therein a plurality of coins that are received via the coin receiving opening 2 and pass through the coin receiving guide 1. The input section 90 is provided with a plurality of input reverse rollers 91.

The multiple input reverse rollers 91 are provided above the holding sections 31 (a part of the conveyance section 30) having the long protrusions 31*a*1 placed in the third rail component 21*a*3 and extend along the front-rear direction. The input reverse rollers 91 are coupled to an input motor 93 with a connection member 92 interposed therebetween. The input reverse rollers 91 each rotate about its shaft center when the input motor 93 is driven.

The input reverse rollers 91 each rotate about its shaft center, abut the coins stored in the input section 90, and house the coins one by one in the housing recesses 31*a* of the holding sections 31 having the long protrusions 31*a*1 placed in a part of the conveyance section 30 being in displaced, i.e., the third rail component 21*a*3.

The upper base member 42 has a first curved base 42*a*, a second curved base 42*b*, and a horizontal base 42*c*.

The first curved base 42*a* is provided such that the first curved base 42*a* faces the fourth rail component 22*a*1 in which a part of the conveyance section 30 is placed of the second rail forming member 22. The first curved base 42*a* prevents the coin from being separated from each of the housing recesses 31*a* of the holding sections 31 having the long protrusions 31*a*1 placed in a part of the conveyance section 30 in being displaced, i.e., the fourth rail component 22*a*1.

The second curved base 42*b* is provided such that the second curved base 42*b* faces the eighth rail component 22*a*5 in which a part of the conveyance section 30 is placed of the second rail forming member 22. The second curved base 42*b* prevents the coin from being separated from each of the housing recesses 31*a* of the holding sections 31 having the long protrusions 31*a*1 placed in a part of the conveyance section 30 in being displaced, i.e., the eighth rail component 22*a*5.

Figure 6:
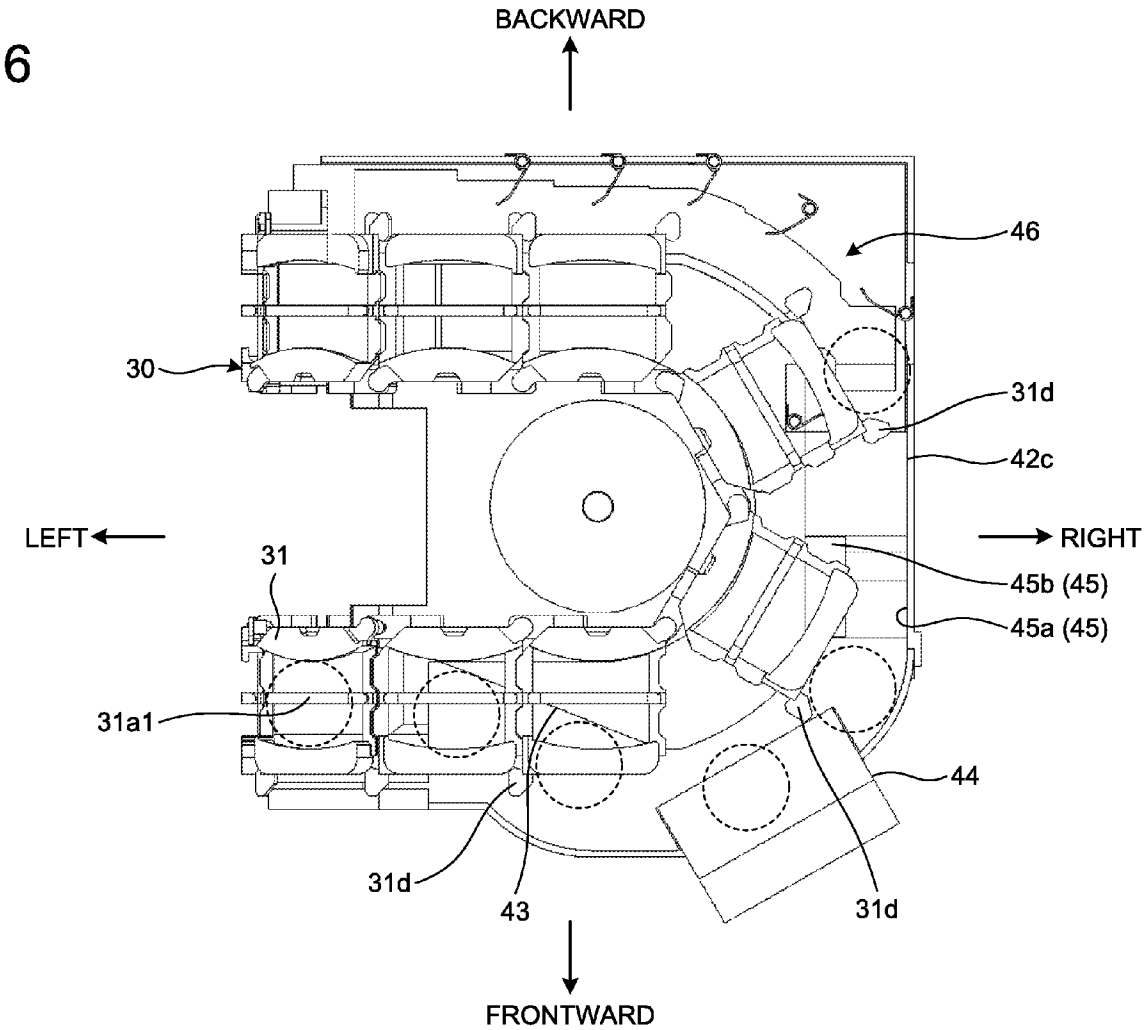
FIG. 6 is a plan view of the main part of the conveyance mechanism illustrated in FIGS. 1 to 4.

The horizontal base 42*c* is provided such that the horizontal base 42*c* faces the fifth rail component 22*a*2, the sixth rail component 22*a*3, and the seventh rail component 22*a*4 in each of which a part of the conveyance section 30 is placed of the second rail forming member 22. As illustrated in FIG. 6, the horizontal base 42*c* is provided with a separation slope section 43, an identification unit 44, a rejection section 45, and a sorting section 46.

The separation slope section 43 is formed at a position facing the fifth rail component 22*a*2 of the rail section, and is gradually tilted forward as the separation slope section 43 proceeds in the right direction. The separation slope section 43 separates the coin from a part of the conveyance section 30 in being displaced, i.e., the housing recess 31*a* of the holding section 31 having the long protrusion 31*a*1 placed in the fifth rail component 22*a*2 to the outside of the holding section 31. The coin separated from the inside to the outside of the holding section 31, which is illustrated with the broken line in FIG. 6, is conveyed by being pushed with the pushing protrusion 31*d* of the holding section 31 in being displaced while being in slide contact with the edge of the horizontal base 42*c*.

The identification unit 44 is provided at the front end on the right side of the horizontal base 42*c*. The identification unit 44 identifies the authenticity and the denomination of the coin that is separated from the inside to the outside of the holding section 31 by the separation slope section 43 and conveyed while being pushed with the pushing protrusion 31*d* of the holding section 31, and has a function as a counter that measures the number of coins. An identification result by the identification unit 44 is given to the control unit 100 as an identification signal.

The rejection section 45 is provided at the right end of the horizontal base 42*c*. The rejection section 45 includes a rejection opening 45*a* and a rejection gate 45*b*.

The rejection opening 45*a* is formed in a rectangular shape in a pass through region of the coin after passing through an identification region of the identification unit 44, i.e., the coin conveyed by being pushed with the pushing protrusion 31*d* while being in slide contact with the edge of the horizontal base. The rejection opening 45*a* has a size allowing the coins of all denominations conveyed by the conveyance section 30 to pass through the rejection opening 45*a*, and communicates with a coin output tray 3 via a rejection guide 45*c*.

The rejection gate 45*b* is provided such that the rejection gate 45*b* moves forward and backward with respect to the rejection opening 45*a*. When moving forward to the rejection opening 45*a*, the rejection gate 45*b* closes a part of the rejection opening 45*a* to prohibit the coin from passing through the rejection opening 45*a*.

When moving backward from the rejection opening 45*a*, the rejection gate 45*b* allows the coin to pass through the rejection opening 45*a*. As a result, the coin after passing through the rejection opening 45*a* is guided to the coin output tray 3 via the rejection guide 45*c*. The coin guided to the coin output tray 3, thus, may be taken out via a coin output opening 4.

The rejection gate 45*b* moves backward from the rejection opening 45*a* when a rejection driver 45*b*1 (refer to FIG. 15) such as a solenoid is driven. In a normal state, the rejection gate 45*b* moves forward to the rejection opening 45*a*.

Figure 7:
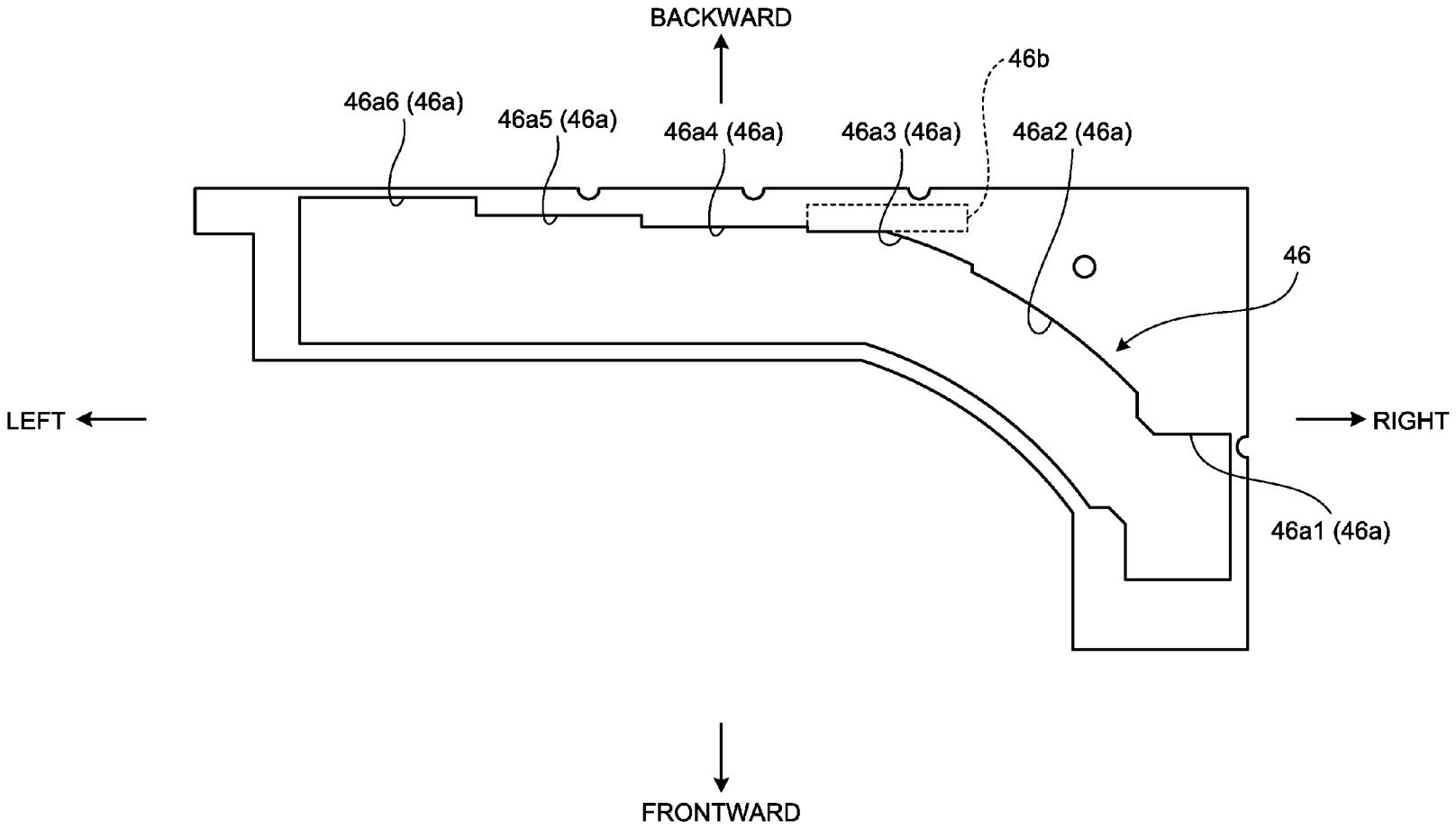
FIG. 7 is an explanatory view schematically illustrating a structure of a sorting section illustrated in FIG. 6.
Figure 8:
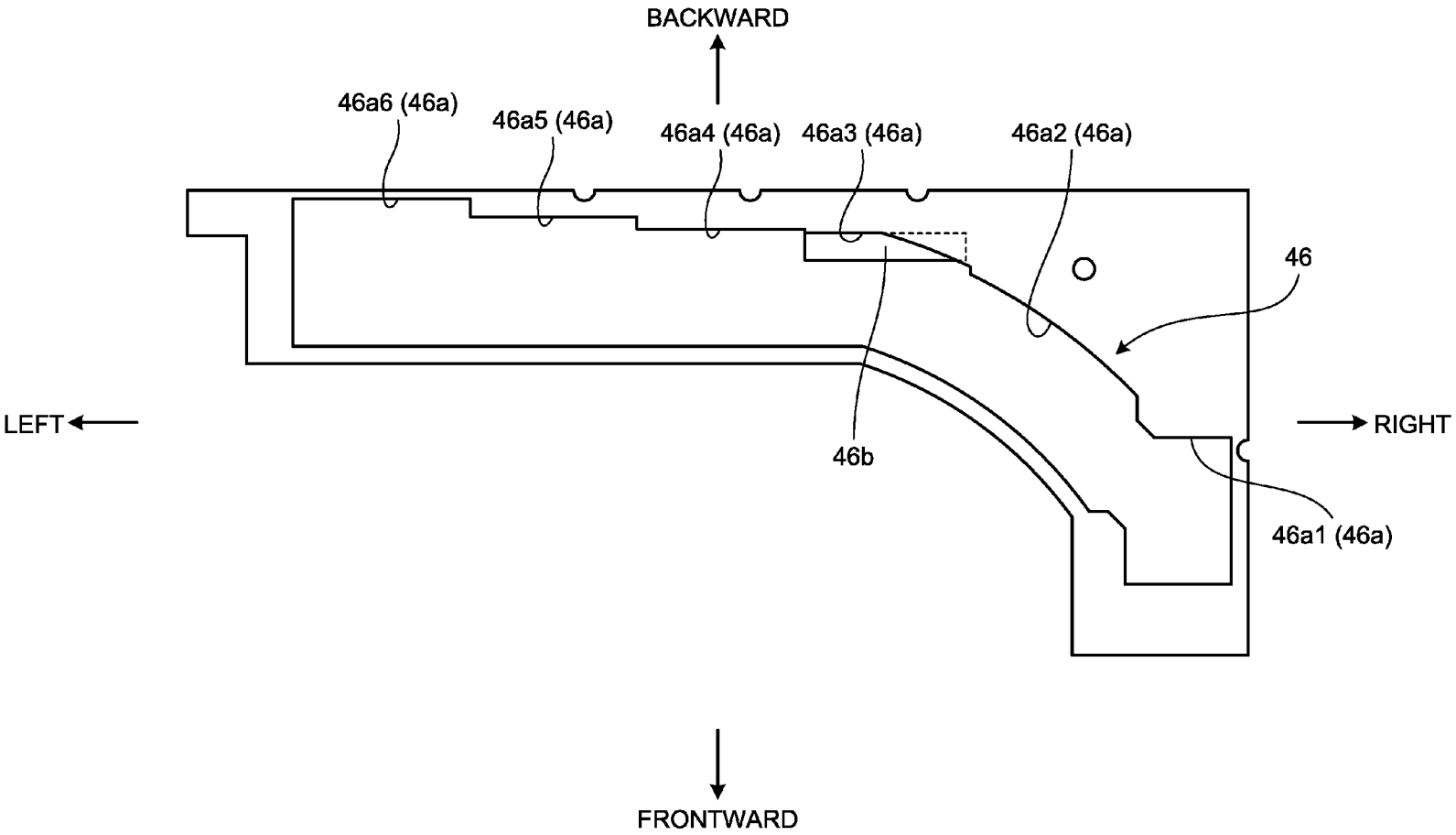
FIG. 8 is another explanatory view schematically illustrating the structure of the sorting section illustrated in FIG. 6.

The sorting section 46 is provided in the pass through region of the coin conveyed by the conveyance section 30 in being displaced, i.e., in the pass through region of the coin conveyed by being pushed with the pushing protrusion 31*d* of the holding section 31, at the rear end of the horizontal base 42*c*. As illustrated in FIGS. 7 and 8, the sorting section 46 is provided with a sort passing opening 46*a*, and a sorting gate 46*b*.

The sort passing opening 46*a* has openings 46*a*1 to 46*a*6 that are provided for respective denominations and arranged continuously side by side in the ascending order of outer diameters of coins in relation to the denominations. More specifically, the sort passing opening 46*a* is an opening formed by openings having different shapes in the following manner: from right to left, i.e., from the upstream side to the downstream side in the coin conveyance direction in the coin pass through region, an opening 46*a*1 for 1 yen coin, an opening 46*a*2 for 50 yen coin, an opening 46*a*3 for 5 yen coin, an opening 46*a*4 for 100 yen coin, an opening 46*a*5 for 10 yen coin, and an opening 46*a*6 for 500 yen coin are formed such that they communicate with one another.

The opening 46*a*1 for 1 yen coin has a size sufficient to allow 1 yen coin to pass through it and prohibits the coin having a larger outer diameter than that of 1 yen coin (50 yen coin, 5 yen coin, 100 yen coin, 10 yen coin, and 500 yen coin) to pass through it. The opening 46*a*2 for 50 yen coin has a size sufficient to allow 50 yen coin to pass through it and prohibits the coin having a larger outer diameter than that of 50 yen coin (5 yen coin, 100 yen coin, 10 yen coin, and 500 yen coin) to pass through it. The opening 46*a*3 for 5 yen coin has a size sufficient to allow 5 yen coin to pass through it and prohibits the coin having a larger outer diameter than that of 5 yen coin (100 yen coin, 10 yen coin, and 500 yen coin) to pass through it. The opening 46*a*4 for 100 yen coin has a size sufficient to allow 100 yen coin to pass through it and prohibits the coin having a larger outer diameter than that of 100 yen coin (10 yen coin and 500 yen coin) to pass through it. The opening 46*a*5 for 10 yen coin has a size sufficient to allow 10 yen coin to pass through it and prohibits the coin having a larger outer diameter than that of 10 yen coin (500 yen coin) to pass through it. The opening 46*a*6 for 500 yen coin has a size sufficient to allow 500 yen coin to pass through it.

The sorting gate 46*b* is provided such that the sorting gate 46*b* may move forward and backward with respect to the opening 46*a*3 for 5 yen coin. The sorting gate 46*b* moves backward from the opening 46*a*3 for 5 yen coin by being driven by a gate driver (not illustrated) when the coin passing through the identification unit 44 is identified to be the same material (e.g., cupronickel) as 100 yen coin as a result of the identification of the denomination by the identification unit 44 (refer to FIG. 7). In contrast, when the coin passing through the identification unit 44 is identified to be a different material from that of 100 yen coin by the identification unit 44, the sorting gate 46*b* moves forward to the opening 46*a*3 for 5 yen coin by being driven by the gate driver (refer to FIG. 8). When moving forward to the opening 46*a*3 for 5 yen coin, the sorting gate 46*b* prohibits 5 yen coin to pass through the opening 46*a*3 for 5 yen coin.

The sorting section 46 thus structured sorts the coins passing through the sort passing opening 46*a* into the temporary storage unit 50 provided below the sorting section 46 by denomination.

Figure 9:
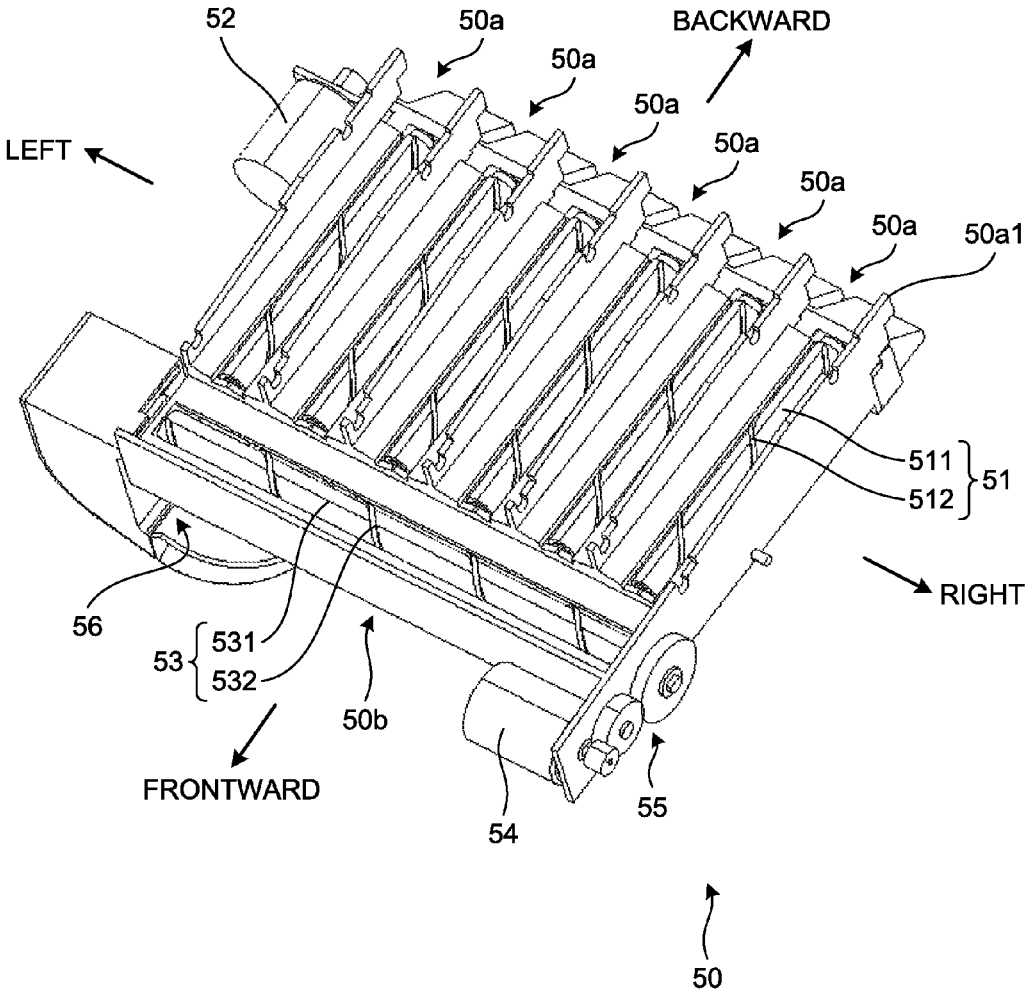
FIG. 9 is a perspective view illustrating a temporary storage unit illustrated in FIGS. 1 and 2.

FIG. 9 is a perspective view illustrating the temporary storage unit 50 illustrated in FIGS. 1 and 2. The temporary storage unit 50 includes a plurality of (in the example illustrated in FIG. 9, the number is six) temporary storage containers 50*a* and a return container 50*b*.

The temporary storage containers 50*a* that temporarily store respective 1 yen coins, 50 yen coins, 5 yen coins, 100 yen coins, 10 yen coins, and 500 yen coins are sequentially arranged side by side from right to left.

The temporary storage container 50*a* for 1 yen coin is provided below the opening 46*a*1 for 1 yen coin. The temporary storage container 50*a* for 1 yen coin temporarily stores therein 1 yen coins passing through the opening 46*a*1 for 1 yen coin. The temporary storage container 50*a* for 50 yen coin is provided below the opening 46*a*2 for 50 yen coin. The temporary storage container 50*a* for 50 yen coin temporarily stores therein 50 yen coins passing through the opening 46*a*2 for 50 yen coin.

The temporary storage container 50*a* for 5 yen coin is provided below the opening 46*a*3 for 5 yen coin. The temporary storage container 50*a* for 5 yen coin temporarily stores therein 5 yen coins passing through the opening 46*a*3 for 5 yen coin. The temporary storage container 50*a* for 100 yen coin is provided below the opening 46*a*4 for 100 yen coin. The temporary storage container 50*a* for 100 yen coin temporarily stores therein 100 yen coins passing through the opening 46*a*4 for 100 yen coin.

The temporary storage container 50*a* for 10 yen coin is provided below the opening 46*a*5 for 10 yen coin. The temporary storage container 50*a* for 10 yen coin temporarily stores therein 10 yen coins passing through the opening 46*a*5 for 10 yen coin. The temporary storage container 50*a* for 500 yen coin is provided below the opening 46*a*6 for 500 yen coin. The temporary storage container 50*a* for 500 yen coin temporarily stores therein 500 yen coins passing through the opening 46*a*6 for 500 yen coin.

The temporary storage containers 50*a* each include a temporary storage screw-type conveyance member 51. The temporary storage screw-type conveyance member 51 is provided to a temporary storage guide 50*a*1 serving as a case. The temporary storage screw-type conveyance member 51 has a temporary storage shaft 511 that extends in the front-rear direction and has a cylindrical shape, and a temporary storage blade member 512 that is spirally provided on the outer periphery of the temporary storage shaft 511 such that the temporary storage blade member 512 protrudes outward from the outer periphery.

The temporary storage screw-type conveyance members 51 of the respective temporary storage containers 50*a* are coupled to a temporary storage motor 52 serving as a shared motor via a connection member (not illustrated). The temporary storage motor 52 is a drive source that may rotate in normal and reverse directions. The temporary storage motor 52 is driven by a command given by the control unit 100. The temporary storage motor 52 driven to rotate in one direction causes the temporary storage screw-type conveyance members 51 in the respective temporary storage containers 50*a* to rotate in one direction. As a result, the coins temporarily stored are conveyed backward to be dispensed to the housing unit 60.

In contrast, the temporary storage motor 52 driven to rotate in the other direction causes the temporary storage screw-type conveyance members 51 in the respective temporary storage containers 50*a* to rotate in the other direction. As a result, the coins temporarily stored are conveyed forward to be dispensed to the return container 50*b*.

The return container 50*b* is provided below on the forward side of the temporary storage containers 50*a*. The return container 50*b* includes a return screw-type conveyance member 53. The return screw-type conveyance member 53 has a return shaft 531 that extends in the left-right direction and has a cylindrical shape, and a return blade member 532 that is spirally provided on the outer periphery of the return shaft 531 such that the return blade member 532 protrudes outward from the outer periphery.

The return screw-type conveyance member 53 is coupled to a return motor 54 via a connection member 55. When the return motor 54 is driven by a command given from the control unit 100, the return screw-type conveyance member 53 rotates about the central axis of the return shaft 531. When rotating about the central axis of the return shaft 531, the return screw-type conveyance member 53 conveys the coins dispensed from the temporary storage containers 50*a* in the left direction.

Figure 10:
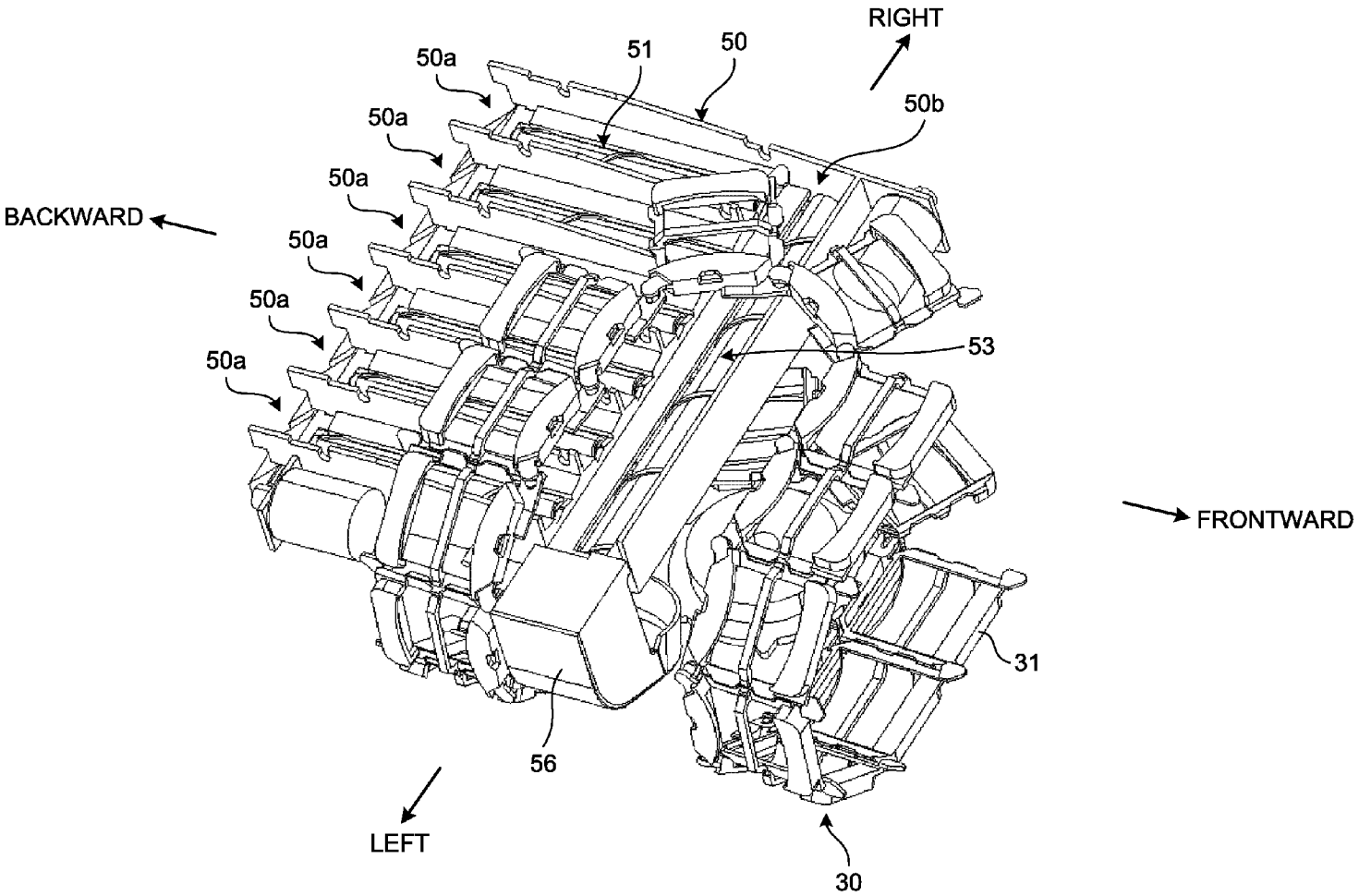
FIG. 10 is another perspective view illustrating the temporary storage unit illustrated in FIGS. 1 and 2.

The coins conveyed in the left direction as described above are dispensed to a return guide 56 provided below on the left direction side of the return container 50*b* as illustrated in FIG. 10. The return guide 56 guides the coins dispensed from the return container 50*b*, via an opening (not illustrated) formed on the backward side of the lower base member 41 of the conveyance mechanism 10, to a part of the conveyance section 30 in being displaced, i.e., each of the housing recesses 31*a* of the housing sections 31 having the long protrusions 31*a*1 placed in the first rail component 21*a*1.

Figure 11:
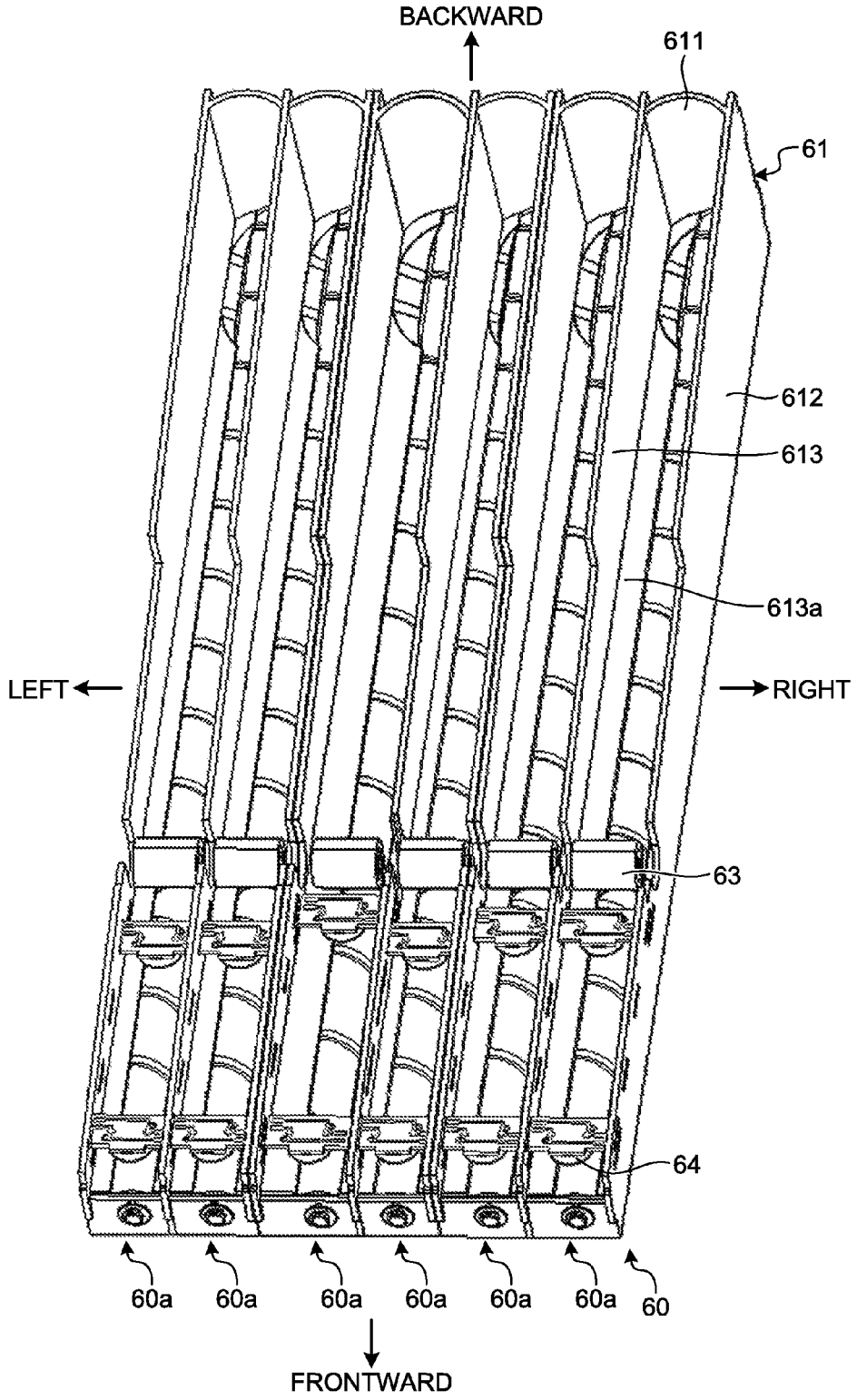
FIG. 11 is a perspective view illustrating a housing unit illustrated in FIGS. 1 and 2.
Figure 12:
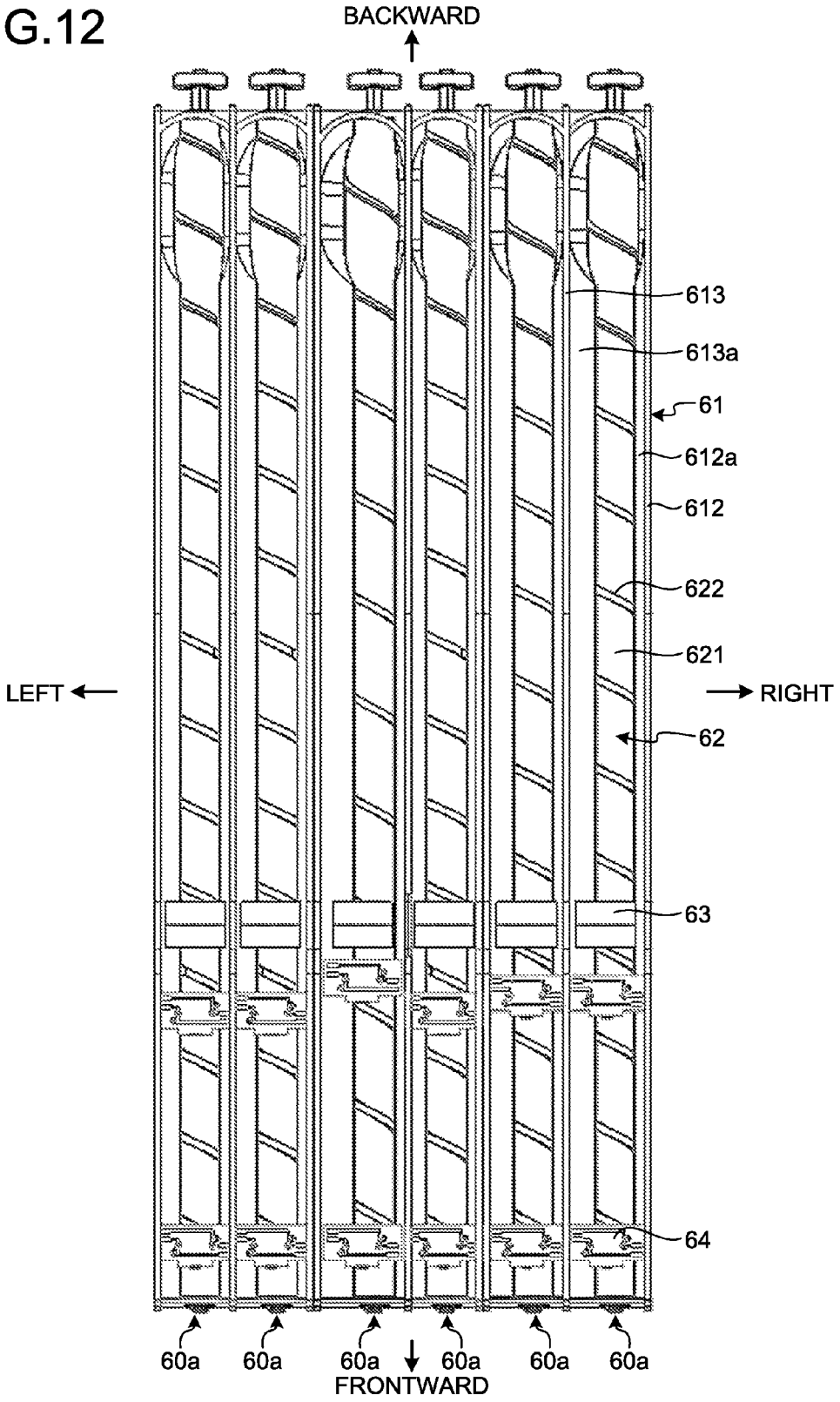
FIG. 12 is a plan view illustrating the housing unit illustrated in FIGS. 1 and 2.

FIGS. 11 and 12 each illustrate the housing unit 60 illustrated in FIGS. 1 and 2. FIG. 11 is a perspective view thereof. FIG. 12 is a plan view thereof. The housing unit 60 includes a plurality of (in the example illustrated in each of FIGS. 11 and 12, the number is six) coin containers 60*a* provided side by side in the left-right direction. The housing unit 60 is provided with coin containers 60*a* that house respective 1 yen coins, 50 yen coins, 5 yen coins, 100 yen coins, 10 yen coins, and 500 yen coins, for example, and are sequentially arranged side by side from right to left.

The coin container 60*a* for housing 1 yen coin is provided below the temporary storage container 50*a* temporarily storing 1 yen coins. The coin container 60*a* for housing 1 yen coin houses 1 yen coins dispensed backward from the temporary storage container 50*a* temporarily storing 1 yen coins. The coin container 60*a* for housing 50 yen coin is provided below the temporary storage container 50*a* temporarily storing 50 yen coins. The coin container 60*a* for housing 50 yen coin houses 50 yen coins dispensed backward from the temporary storage container 50*a* temporarily storing 50 yen coins. The coin container 60*a* for housing 5 yen coin is provided below the temporary storage container 50*a* temporarily storing 5 yen coins. The coin container 60*a* for housing 5 yen coin houses 5 yen coins dispensed backward from the temporary storage container 50*a* temporarily storing 5 yen coins. The coin container 60*a* for housing 100 yen coin is provided below the temporary storage container 50*a* temporarily storing 100 yen coins. The coin container 60*a* for housing 100 yen coin houses 100 yen coins dispensed backward from the temporary storage container 50*a* temporarily storing 100 yen coins. The coin container 60*a* for housing 10 yen coin is provided below the temporary storage container 50*a* temporarily storing 10 yen coins. The coin container 60*a* for housing 10 yen coin houses 10 yen coins dispensed backward from the temporary storage container 50*a* temporarily storing 10 yen coins. The coin container 60*a* for housing 500 yen coin is provided below the temporary storage container 50*a* temporarily storing 500 yen coins. The coin container 60*a* for housing 500 yen coin houses 500 yen coins dispensed backward from the temporary storage container 50*a* temporarily storing 500 yen coins.

The coin containers 60*a* each include a housing guide 61, a housing screw-type conveyance member 62, a housing reverse roller 63, and a dispensing sensor 64.

The housing guide 61 is formed in a case shape in such a manner that the upper and lower portions thereof are open and the longitudinal direction thereof is the front-rear direction. The housing guide 61 has a rear section 611 that is curved such that the central portion of the front surface is concaved. The housing guide 61 has a right side lateral protrusion 612*a* and a left side lateral protrusion 613*a*.

The right side lateral protrusion 612*a* protrudes in the left direction from an inner surface of a right side section 612 of the housing guide 61, and is formed such that the right side lateral protrusion 612*a* is gradually tilted upward as it proceeds forward. The left side lateral protrusion 613*a* protrudes in the right direction from an inner surface of a left side section 613 of the housing guide 61, and is formed such that the left side lateral protrusion 613*a* is gradually tilted upward as it proceeds forward. The right side lateral protrusion 612*a* and the left side lateral protrusion 613*a* are formed such that they protrude to extend close to each other at the same height level.

The protruding length of the left side lateral protrusion 613*a*, i.e., the protruding length of the left side lateral protrusion 613*a* in the right direction from the left side section 613, is larger than the protruding length of the right side lateral protrusion 612*a*, i.e., the protruding length of the right side lateral protrusion 612*a* in the left direction from the right side section 612.

Figure 13:
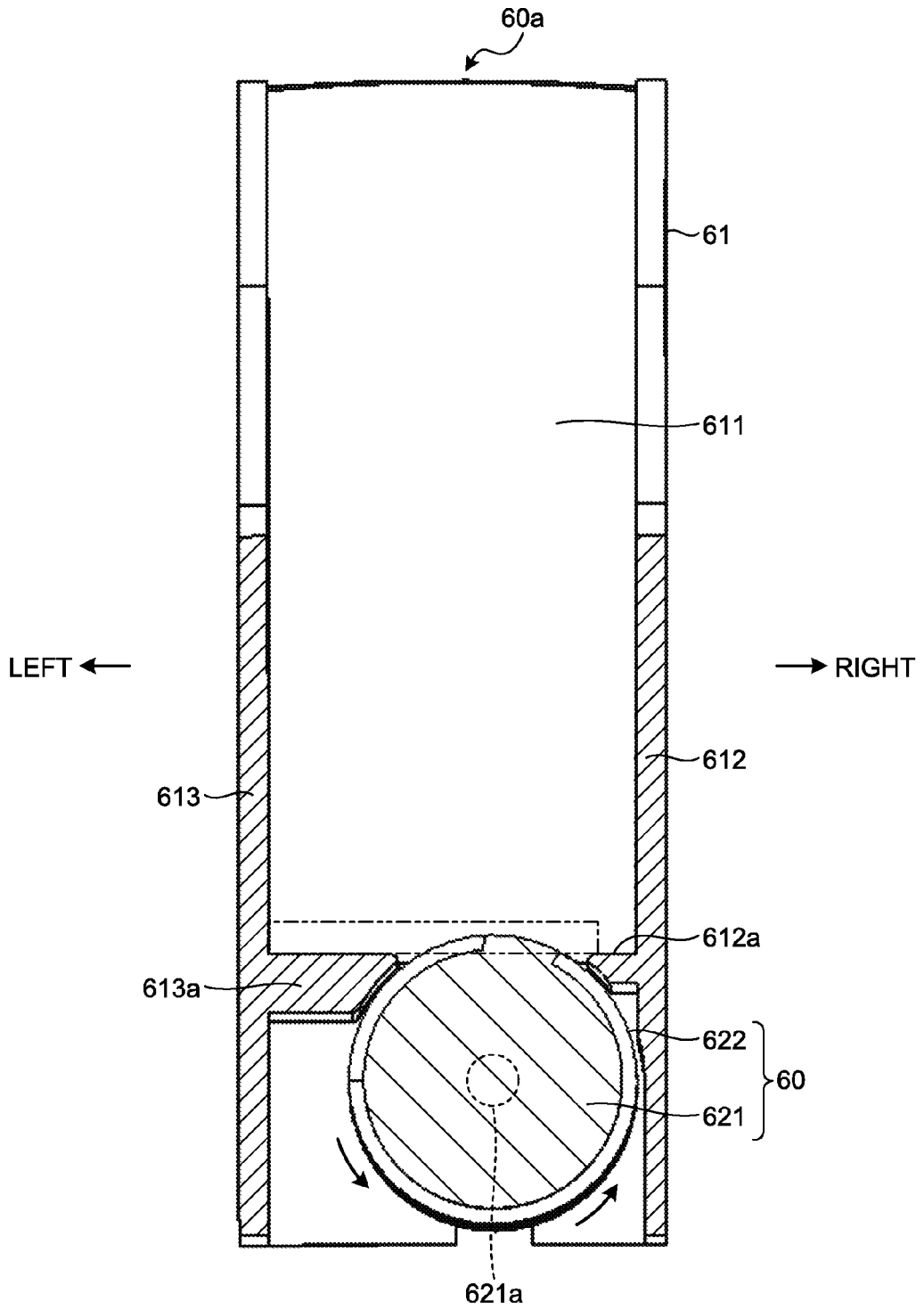
FIG. 13 is a cross-sectional view illustrating a cross section when one of coin containers illustrated in FIGS. 11 and 12 is viewed from the front along an axis direction of a housing shaft.

The housing screw-type conveyance member 62 has a housing shaft 621 that extends in the front-rear direction and has a cylindrical shape, and a housing blade member 622 that is spirally provided on the outer periphery of the housing shaft 621 such that the housing blade member 622 protrudes outward from the outer periphery. The rear end of the housing screw-type conveyance member 62 passes through a notch (not illustrated) formed on a lower portion of the rear section 611 of the housing guide 61 and is connected to a housing motor 65 (refer to FIGS. 1 and 2). As illustrated in FIG. 13, the housing screw-type conveyance member 62 is provided such that the housing screw-type conveyance member 62 is gradually tilted upward as it proceeds forward while a part of the housing shaft 621 and a part of the housing blade member 622 protrude upward from a space between the right side lateral protrusion 612*a* and the left side lateral protrusion 613*a*. A rotating shaft 621*a* of the housing screw-type conveyance member 62 is positioned on the lower side of the right side lateral protrusion 612*a* and the left side lateral protrusion 613*a*.

The housing screw-type conveyance member 62 is gradually tilted backward as the housing blade member 622, which protrudes upward from the space between the right side lateral protrusion 612*a* and the left side lateral protrusion 613*a*, proceeds from one direction (right direction) to the other direction (left direction) in the left-right direction. In other words, the housing screw-type conveyance member 62 is gradually tilted backward as the housing blade member 622 proceeds from one direction (right direction) to the other direction (left direction) in the left-right direction when viewed from above.

The protruding length of the left side lateral protrusion 613*a* is larger than that of the right side lateral protrusion 612*a*. The screw-type conveyance member is, thus, provided at such an off-center position that the screw-type conveyance member is close to the right side section 612 (on one direction side in the left-right direction) and is apart from the left side section 613 (on the other direction side in the left-right direction) in the housing guide 61.

When the housing motor 65 is driven by a command given from the control unit 100, the housing screw-type conveyance member 62 rotates in one direction (in a counterclockwise direction viewed from the front) about the central axis of the housing shaft 621, i.e., rotates about the central axis such that the housing blade member 622 proceeds from one direction to the other direction in the left-right direction in the space between the right side lateral protrusion 612*a* and the left side lateral protrusion 613*a*. While rotating in such a manner described above, the housing screw-type conveyance member 62 conveys forward the coins that are housed in pitch intervals of the housing blade member 622 and are under the right side lateral protrusion 612*a* and the left side lateral protrusion 613*a*. In the embodiment, the pitch interval of the housing blade member 622 is a distance between parts of the housing blade member 622 adjacent to each other when the housing screw-type conveyance member 62 is viewed from above, and has a size not allowing a plurality of conveyance target coins to be housed therein.

The housing reverse roller 63 extends along the left-right direction. The housing reverse roller 63 is supported in a rotatable manner by the housing guide 61 above the housing screw-type conveyance member 62 slightly on the forward side from the central portion of the housing screw-type conveyance member 62 in the front-rear direction. The housing reverse roller 63 is connected to a motor (not illustrated). When the motor is driven, the housing reverse roller 63 rotates about its axis center. While rotating, the housing reverse roller 63 abuts the coins conveyed by the housing screw-type conveyance member 62 and houses the coins one by one in the pitch intervals of the housing blade member 622 of the housing screw-type conveyance member 62 on the forward side of the housing reverse roller 63.

The dispensing sensor 64 is provided above the housing screw-type conveyance member 62 at the front end of the housing screw-type conveyance member 62. The dispensing sensor 64 detects the coin dispensed forward by the rotation of the housing screw-type conveyance member 62. A detection result of the dispensing sensor 64 is given to the control unit 100.

Figure 14:
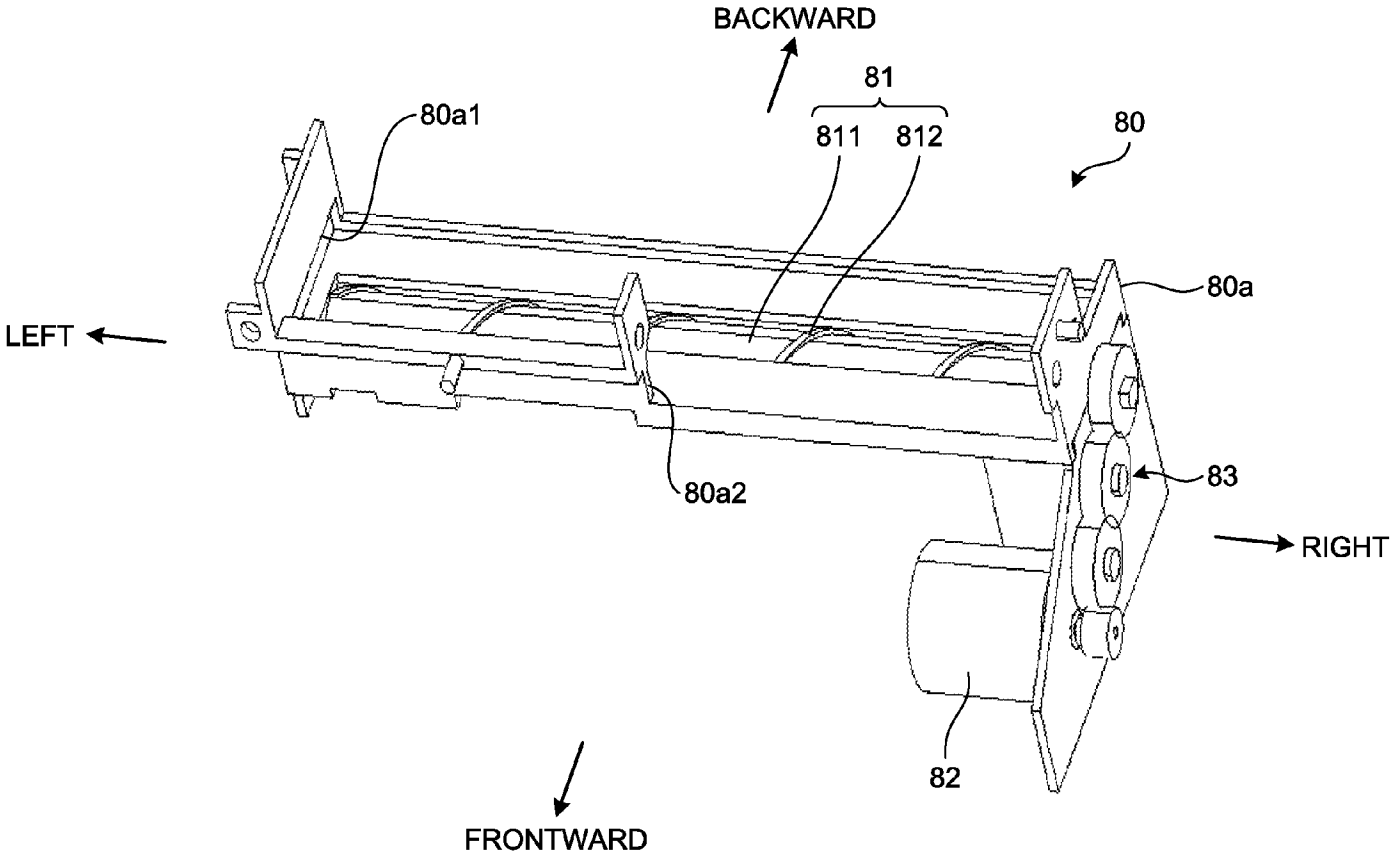
FIG. 14 is a perspective view illustrating a coin output suspending unit illustrated in FIGS. 1 and 2.

FIG. 14 is a perspective view illustrating the coin output suspending unit 80 illustrated in FIGS. 1 and 2. The coin output suspending unit 80 is provided below on the forward side of the housing unit 60. The coin output suspending unit 80 includes a coin output suspending screw-type conveyance member 81. The coin output suspending screw-type conveyance member 81 is provided to a coin output suspending guide 80*a* serving as a case. The coin output suspending screw-type conveyance member 81 has a coin output suspending shaft 811 that extends in the left-right direction and has a cylindrical shape, and a coin output suspending blade member 812 that is spirally provided on the outer periphery of the coin output suspending shaft 811 such that the coin output suspending blade member 812 protrudes outward from the outer periphery.

The coin output suspending screw-type conveyance member 81 is coupled to a coin output suspending motor 82 with a connection member 83. The coin output suspending motor 82 is a drive source that may rotate in normal and reverse directions. The coin output suspending motor 82 is driven by a command given by the control unit 100. The coin output suspending motor 82 driven to rotate in one direction causes the coin output suspending screw-type conveyance member 81 to rotate in one direction. As a result, the coin output suspending screw-type conveyance member 81 conveys the coins in the left direction and dispenses the coins to the input section 90 from a feeding opening 80*a*1 provided to the coin output suspending guide 80*a*.

In contrast, the coin output suspending motor 82 driven to rotate in the other direction causes the coin output suspending screw-type conveyance member 81 to rotate in the other direction. As a result, the coin output suspending screw-type conveyance member 81 conveys the coins in the right direction and dispenses the coins to the coin output tray 3 from a dispensing opening 80*a*2 provided to the coin output suspending guide 80*a*. The dispensing opening 80*a*2 is opened or closed by a dispensing door 84 (refer to FIG. 2). The dispensing door 84 is swung by being driven by a door drive mechanism 85 (refer to FIG. 15) that is an actuator.

Figure 15:
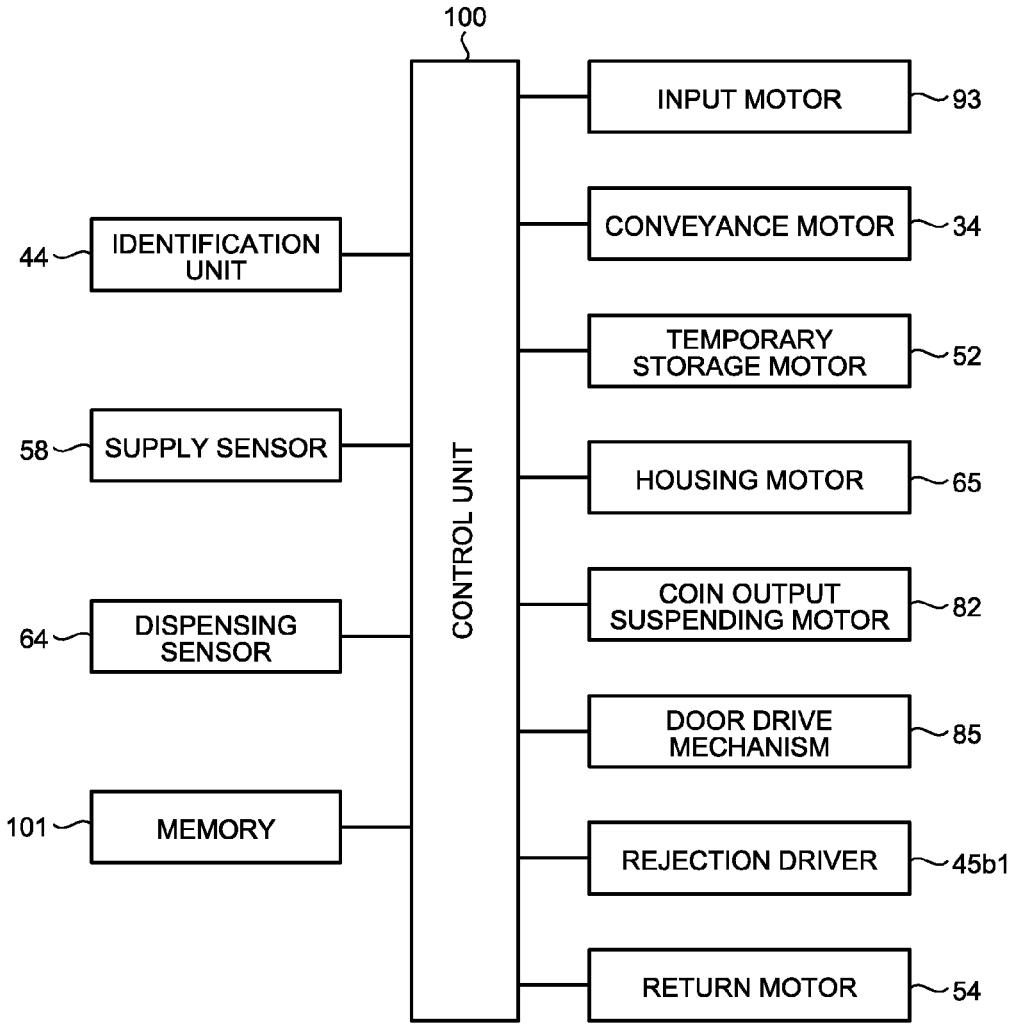
FIG. 15 is a block diagram illustrating a main part of a control system of the coin processing apparatus in the embodiment of the present disclosure.

FIG. 15 is a block diagram illustrating a main part of a control system of the coin processing apparatus in the embodiment of the present disclosure. As illustrated in FIG. 15, the coin processing apparatus includes the control unit 100 and supply sensors 58 in addition to the structure described above. The control unit 100 overall controls the respective components of the coin processing apparatus in accordance with a program and data stored in a memory 101. The supply sensors 58 are provided at the rear ends of the respective temporary storage containers 50*a* included in the temporary storage unit 50. Each supply sensor 58 detects the coin supplied to the corresponding coin container 60*a* from the temporary storage container 50*a*.

The supply sensor 58 provided at the rear end of the temporary storage container 50*a* for 1 yen coin detects the coin supplied to the coin container 60*a* for 1 yen coin from the temporary storage container 50*a* for 1 yen coin. The supply sensor 58 provided at the rear end of the temporary storage container 50*a* for 50 yen coin detects the coin supplied to the coin container 60*a* for 50 yen coin from the temporary storage container 50*a* for 50 yen coin. The supply sensor 58 provided at the rear end of the temporary storage container 50*a* for 5 yen coin detects the coin supplied to the coin container 60*a* for 5 yen coin from the temporary storage container 50*a* for 5 yen coin. The supply sensor 58 provided at the rear end of the temporary storage container 50*a* for 100 yen coin detects the coin supplied to the coin container 60*a* for 100 yen coin from the temporary storage container 50*a* for 100 yen coin. The supply sensor 58 provided at the rear end of the temporary storage container 50*a* for 10 yen coin detects the coin supplied to the coin container 60*a* for 10 yen coin from the temporary storage container 50*a* for 10 yen coin. The supply sensor 58 provided at the rear end of the temporary storage container 50*a* for 500 yen coin detects the coin supplied to the coin container 60*a* for 500 yen coin from the temporary storage container 50*a* for 500 yen coin. Detection results of the respective supply sensors 58 are given to the control unit 100.

The following describes operation of the coin processing apparatus thus structured in the embodiment. First, the operation is described when coins are received via the coin receiving opening 2.

In this case, the coin processing apparatus causes the input section 90 to store the received coins. After the coins are stored in the input section 90, the coin processing apparatus drives the input motor 93 and the conveyance motor 34 via the control unit 100. As a result of the driving of the input motor 93 and the conveyance motor 34 to rotate, the respective input reverse rollers 91 each rotate about its shaft center and the conveyance section 30 is displaced along the conveyance path 20*a*.

The input reverse rollers 91 each rotate about its shaft center, abut the coins stored in the input section 90, and house the coins one by one in a part of the conveyance section 30 in being displaced, i.e., in the housing recesses 31*a* of the holding sections 31 having the long protrusions 31*a*1 placed in the third rail component 21*a*3. With the displacement of the conveyance section 30, the coins housed in the housing recesses 31*a* are conveyed upward along the conveyance path 20*a*.

The conveyance base 40 (the upper base member 42) included in the conveyance mechanism 10 has the separation slope section 43 formed thereto. The conveyance mechanism 10 causes the coin conveyed upward by the conveyance section 30 to bring contact with the separation slope section 43 to position the coin outside the holding section 31, and conveys the coin by pushing it with the pushing protrusion 31*d* while the coin is in slide contact with the edge of the horizontal base 42*c* of the upper base member 42.

The conveyance mechanism 10 conveys the coin by pushing it with the pushing protrusion 31*d* in this way. As a result, the conveyance mechanism 10 causes the coin to pass through the identification region of the identification unit 44, by which the authenticity and the denomination of the coin are identified. The conveyance mechanism 10 allows the authentication and the denomination of the coin to be identified by the identification unit 44 during the conveyance of the coin.

When the passing coin is identified to be a true coin as a result of the identification by the identification unit 44, the coin processing apparatus dose not drive the rejection driver 45*b*1 via the control unit 100. The rejection gate 45*b* is, thus, in a state of the forward movement with respect to the rejection opening 45*a*. The coin processing apparatus, thus, causes the coin after passing through the identification region to move backward across the rejection opening 45*a* by the conveyance section 30 while pushing the coin with the pushing protrusion 31*d* of the holding section 31.

The coin processing apparatus conveys the coin after moving across the rejection opening 45*a* as described above to the sorting section 46. In the sorting section 46, the coin processing apparatus causes the coin to pass through the coin opening 46*a*1 corresponding to the denomination of the coin, for example, in the sort passing opening 46*a* to sort the coin. As a result of the sorting, the coin after passing through the sort passing opening 46*a* is temporarily stored by the temporary storage container 50*a* corresponding to the denomination of the coin in the temporary storage unit 50. The coin processing apparatus causes the temporary storage unit 50 to temporarily store therein the coins as described above, and thereafter is in a waiting state until a command for the establishment of a transaction, for example, is given by a high-order apparatus, for example. In the waiting state, the coin processing apparatus stops the driving of the input motor 93 and the conveyance motor 34.

When it is identified that the material of the coin is the same as that of 100 yen coin as a result of the identification of the denomination of the coin by the identification unit 44, the coin processing apparatus causes the gate driver to drive the sorting gate 46*b* to move forward to the coin opening 46*a*3 for 5 yen coin in the sorting section 46. As a result, when the coin is 100 yen coin, it is prevented that 100 yen coin having an outer diameter very slightly different from that of 5 yen coin passes through the coin opening 46*a*3 for 5 yen coin.

When it is identified that the material of the coin is different from that of 100 yen coin as a result of the identification of the denomination of the coin by the identification unit 44, the coin processing apparatus causes the gate driver to drive the sorting gate 46*b* to move backward from the coin opening 46*a*3 for 5 yen coin in the sorting section 46. As a result, when the coin is 5 yen coin, the coin is allowed to pass through the coin opening 46*a*3 for 5 yen coin.

When the passing coin is identified to be a false coin as a result of the identification by the identification unit 44, the coin processing apparatus drives the rejection driver 45*b*1 via the control unit 100. As a result, the rejection gate 45*b* moves backward from the rejection opening 45*a*. This movement causes the coin after passing through the identification region of the identification unit 44 to pass through the rejection opening 45*a*. As a result, the coin is dispensed to the coin output tray 3 via the rejection guide 45*c*. The coin dispensed to the coin output tray 3 may be taken out via the coin output opening 4.

When a command of the establishment of a transaction is given from the high-order apparatus after the coins are temporarily stored in the corresponding respective temporary storage containers 50*a* of the temporary storage unit 50, the coin processing apparatus drives the temporary storage motor 52 to rotate in one direction via the control unit 100. As a result, each temporary storage screw-type conveyance member 51 rotates in one direction, conveys the coins temporarily stored in the corresponding temporary storage container 50*a* backward, dispenses the coins to the coin container 60*a* (housing unit 60) corresponding to the denomination. The coins are housed in the corresponding coin container 60*a*. The coin receiving operation of the received coins via the coin receiving opening 2 ends. Thereafter, the driving of the respective motors including the temporary storage motor 52 is stopped.

As described above, in the housing unit 60, the housing motor 65 is driven to rotate in one direction so as to rotate the housing screw-type conveyance member 62 in one direction, and the housing reverse roller 63 is driven to rotate so as to house the coins one by one in the pitch intervals of the housing blade member 622 of the housing screw-type conveyance member 62 on the forward side of the housing reverse roller 63.

When a coin return command is given from the high-order apparatus due to the unsuccessful establishment of a transaction after the coins are temporarily stored in the corresponding respective temporary storage containers 50*a* of the temporary storage unit 50, the coin processing apparatus drives the temporary storage motor 52 to rotate in the other direction and drives the return motor 54 via the control unit 100. Furthermore, the coin processing apparatus drives the conveyance motor 34 and the rejection driver 45*b*1 via the control unit 100.

The temporary storage motor 52 driven to rotate in the other direction causes the temporary storage screw-type conveyance members 51 to rotate in the other direction. As a result, the coin processing apparatus conveys the coins temporarily stored in the respective corresponding temporary storage containers 50*a* forward and dispenses the coins to the return container 50*b*.

In the return container 50*b* to which the coins are dispensed, the return motor 54 drives the return screw-type conveyance member 53 to rotate about the central axis of the return shaft 531. As a result, the return screw-type conveyance member 53 conveys the coins dispensed from the temporary storage containers 50*a* in the left direction and dispenses the coins to the return guide 56. The coins dispensed to the return guide 56 as described above are housed in the housing recesses 31*a* of the holding sections 31 included in the conveyance section 30 in being displaced by being driven by the conveyance motor 34. The coins are conveyed along the conveyance path 20*a*.

Each of the coins conveyed by the conveyance section 30 is separated by the separation slope section 43 from the inside to the outside of the holding section 31 and conveyed by being pushed with the pushing protrusion 31*d* of the holder section 31, as described above. Each of the coins passes through the identification region of the identification unit 44, and thereafter passes through the rejection opening 45*a*, from which the rejection gate 45*b* moves backward by being driven by the rejection driver 45*b*1, to reach the coin output tray 3 via the rejection guide 45*c*.

When receiving the return command, the coin processing apparatus dispenses the coins from the temporary storage containers 50*a* to the return container 50*b*, and dispenses the coins from the return container 50*b* to the conveyance mechanism 10. The coin processing apparatus conveys the coins upward along the conveyance path 20*a* by the conveyance mechanism 10, and dispenses the coins, as the return, to the coin output tray 3 via the rejection opening 45*a* from which the rejection gate 45*b* moves backward. Thereafter, the driving of the respective motors including the conveyance motor 34 is stopped.

The following describes the operation to output the coins stored in the housing unit 60 when a coin output command is given by the high-order apparatus.

In this case, the coin processing apparatus drives the housing motor 65 corresponding to the denomination of the coin serving as the target of the coin output instruction to rotate in one direction via the control unit 100, and drives the coin output suspending motor 82 to rotate in the other direction. Furthermore, the coin processing apparatus drives the door drive mechanism 85 via the control unit 100 so as to open the dispensing opening 80*a*2 by swinging the dispensing door 84.

The coin processing apparatus drives the certain housing motor 65 to rotate in one direction. As a result, in the corresponding coin container 60*a*, the coins housed in the pitch intervals of the housing blade member 622 at the front end of the housing screw-type conveyance member 62 are sequentially dispensed from the coin at the forefront position by the certain number of coins according to the coin output instruction to the coin output suspending unit 80.

When the operation is performed to dispense the coins to the coin output suspending unit 80 from the coin container 60*a* corresponding to the target denomination, the control unit 100 of the coin processing apparatus performs the following dispensing control processing in accordance with the number of coins housed in the coin container 60*a* as remains.

Figure 16:
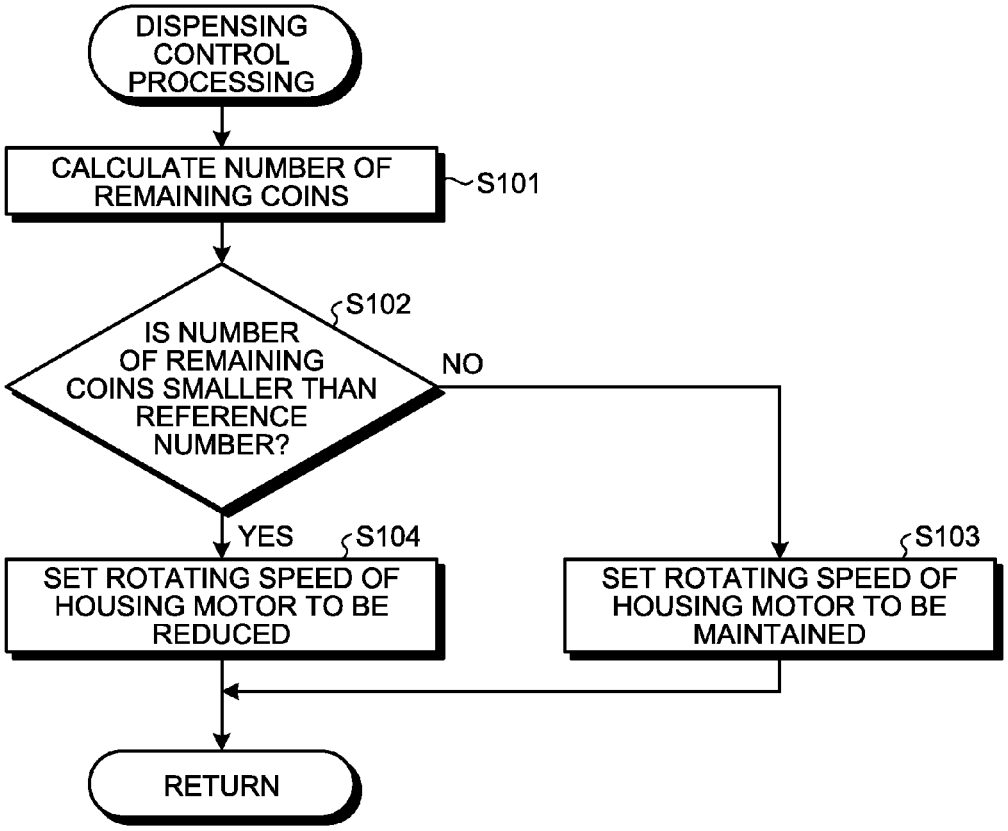
FIG. 16 is a flowchart illustrating a procedure of dispensing control processing performed by the control unit illustrated in FIG. 15.

FIG. 16 is a flowchart illustrating a procedure of the dispensing control processing performed by the control unit 100 illustrated in FIG. 15.

In the dispensing control processing, the control unit 100 calculates the number of coins remaining in the corresponding coin container 60*a* (step S101). The control unit 100 calculates the number of remaining coins by subtracting the number of dispensed coins obtained from a detection result of the dispensing sensor 64 from the number of supplied coins obtained from a detection result of the supply sensor 58.

After calculating the number of remaining coins, the control unit 100 reads information about a reference number serving as a threshold from the memory 101, and determines whether the number of remaining coins is smaller than the reference number (step S102). The reference number is taken from an experimental result for each coin container 60*a*, for example. If the number of remaining coins is smaller than the reference number, the coins are housed on the housing screw-type conveyance member 62 on the backward side of the housing reverse roller 63 in such a manner that the coins are not accumulated.

If the number of remaining coins is equal to or larger than the reference number (Yes at step S102), the control unit 100 sets the rotating speed of the corresponding housing motor 65 to be maintained (step S103). Thereafter, the procedure is returned and the processing ends.

In contrast, if the number of remaining coins is smaller than the reference number (No at step S102), the control unit 100 sets the rotating speed of the corresponding housing motor 65 to be reduced (step S104). Thereafter, the procedure is returned and the processing ends.

As a result of the reduction of the rotating speed of the housing motor 65, the rotating speed of the housing screw-type conveyance member 62 in one direction is reduced.

In the coin output suspending unit 80 to which the coins are dispensed from the corresponding coin containers 60*a*, the coin output suspending screw-type conveyance member 81 is caused to rotate in the other direction by the coin output suspending motor 82 driven to rotate in the other direction, thereby conveying the coins dispensed to the coin output suspending unit 80 in the right direction. The coins are dispensed to the coin output tray 3 via the dispensing opening 80*a*2, which is open. The coin output operation ends. Thereafter, the driving of the respective motors is stopped.

When an abnormality occurs such as a case where the number of coins dispensed from the corresponding coin container 60*a* is larger than the number of coins instructed by the coin output instruction, the control unit 100 of the coin processing apparatus performs the following output coin number correction processing.

Figure 17:
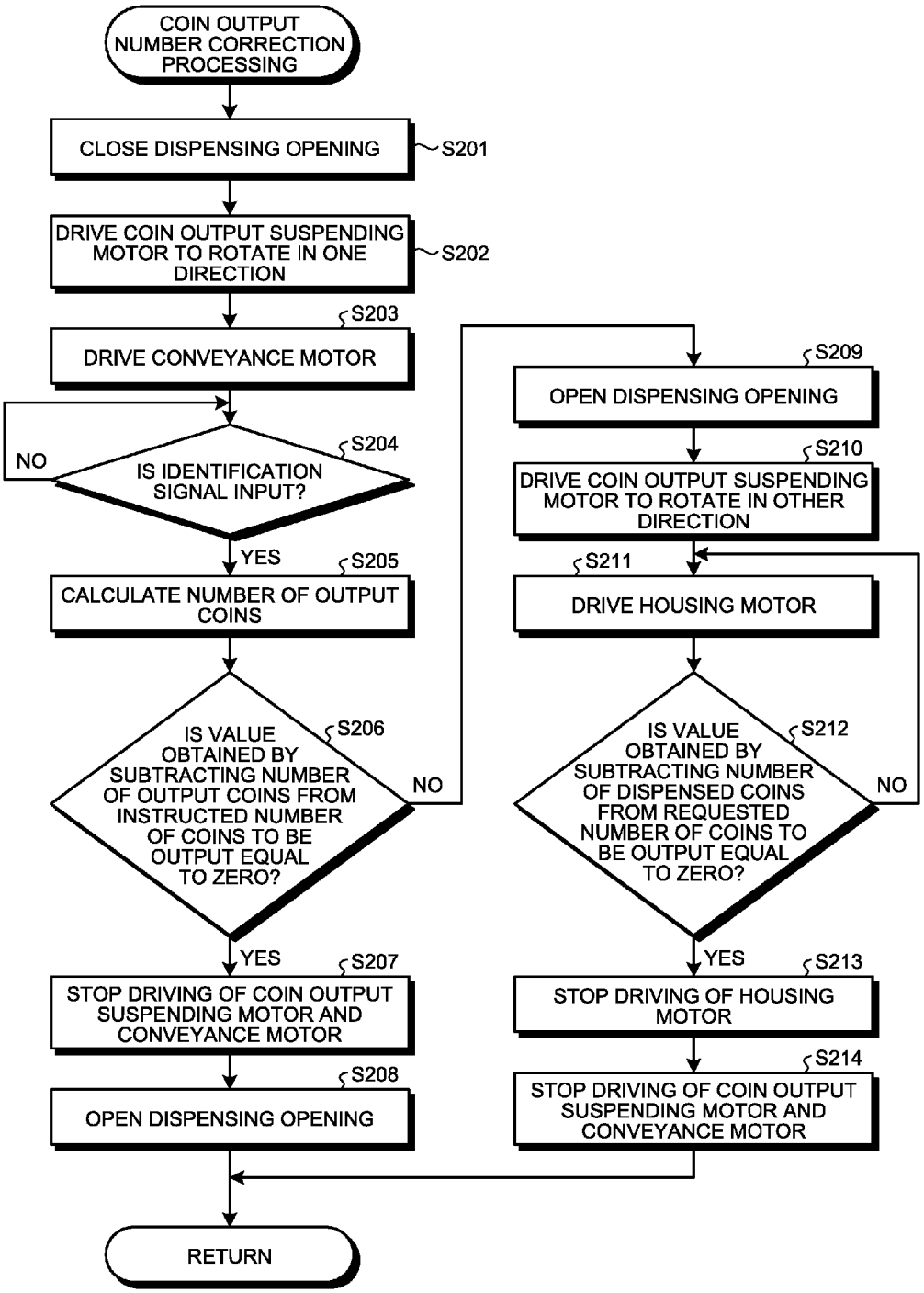
FIG. 17 is a flowchart illustrating a procedure of output coin number correction processing performed by the control unit illustrated in FIG. 15.

FIG. 17 is a flowchart illustrating a procedure of the output coin number correction processing performed by the control unit 100 illustrated in FIG. 15.

In the output coin number correction processing, the control unit 100 drives the door drive mechanism 85 to close the dispensing opening 80*a*2 (step S201), and thereafter, drives the coin output suspending motor 82 to rotate in one direction, and drives the conveyance motor 34 (step S202 and step S203).

The close of the dispensing opening 80*a*2 may prevent all of the coins dispensed to the coin output suspending unit 80 from being fed to the coin output tray 3 via the dispensing opening 80*a*2. The coin output suspending motor 82 driven to rotate in one direction causes the coin output suspending screw-type conveyance member 81 to rotate in one direction. As a result, the coins in the coin output suspending unit 80 are conveyed in the left direction to be dispensed to the input section 90 from the feeding opening 80*a*1. In addition, the conveyance section 30 is displaced by being driven by the conveyance motor 34. As a result, the conveyance section 30 may convey the coins dispensed to the input section 90 one by one.

After the processing at step S203, the control unit 100 waits for input of the identification signal from the identification unit 44 (step S204). If the identification signal is input from the identification unit 44 (step S204), the control unit 100 calculates the number of output coins by subtracting the number of coins included in the identification signal (the number of measured coins) from the number of coins detected by the dispensing sensor 64 (the number of coins dispensed from the coin container 60*a*) (step S205). The calculation, which subtracts the number of coins measured by the identification unit 44 from the number coins dispensed from the coin container 60*a*, may calculate the number of coins already dispensed to the coin output tray 3.

After the calculation of the number of output coins as described above, the control unit 100 determines whether the number of output coins is equal to the number of coins instructed by the coin output instruction as the output (step S206).

If the number of output coins is equal to the number of coins instructed by the coin output instruction as the output (Yes at step S206), the coins the number of which is equal to that instructed by the coin output instruction are already dispensed to the coin output tray 3. The control unit 100, thus, stops the driving of the coin output suspending motor 82 and the conveyance motor 34, and then drives the door drive mechanism 85 to open the dispensing opening 80*a*2 (step S207 and step S208). Thereafter, the procedure is returned and the processing ends.

The output coin number correction processing makes it possible to collect the coins dispensed extra than the number of coins instructed by the coin output instruction, and, after the collection, makes it possible to house the extra coins in the corresponding coin container 60*a* by driving the temporary storage motor 52.

If the number of output coins is unequal to the number of coins instructed by the coin output instruction as the output (No at step S206), the number of coins dispensed to the coin output tray 3 (the number of output coins) is smaller than the number of coins instructed by the coin output instruction as the output. The control unit 100, thus, drives the door drive mechanism 85 to open the dispensing opening 80*a*2 (step S209). The control unit 100 drives the coin output suspending motor 82 to rotate in the other direction, and drives the housing motor 65 of the corresponding coin container 60*a* (step S210 and step S211). As a result, the coins are dispensed to the coin output suspending unit 80 from the coin container 60*a*, and thereafter the coins are dispensed to the coin output tray 3 via the dispensing opening 80*a*2.

The control unit 100 determines whether the number of coins dispensed from the coin container 60*a* (the number of dispensed coins) is equal to the number of coins requested to be output (the number obtained by subtracting the number of coins already output from the number of coins instructed by the coin output instruction) (step S212).

If the number of dispensed coins is equal to the number of coins requested to be output, the control unit 100 stops the driving of the housing motor 65 and thereafter stops the driving of the coin output suspending motor 82 and the conveyance motor 34 (step S213 and step S214). Thereafter, the procedure is returned and the processing ends.

The output coin number correction processing may newly dispense the coins number of which is equal to the number of coins insufficient to the number of coins instructed by the coin output instruction.

In the coin processing apparatus in the embodiment, the housing screw-type conveyance member 62 conveys the coins in the coin container 60*a*, as described above. The coin processing apparatus, thus, may prevent the occurrence of a conveyance failure such as the reduction in conveyance force caused by dirt coming from the coins in being conveyed or the occurrence of inclined coins, thereby making it possible to convey the coins successfully.

In the coin processing apparatus, when the housing screw-type conveyance member 62 rotates about the central axis of the housing shaft 621 in one direction (in the counterclockwise direction viewed from the front), the coins are conveyed forward while being shifted to the left as illustrated in FIG. 13. In addition, the housing screw-type conveyance member 62 is provided at such an off-center position that the housing screw-type conveyance member 62 is close to the right side section 612 of the housing guide 61 (one direction side in the left-right direction) and apart from the left side section 613 (the other direction side in the left-right direction). The housing blade member 622, thus, may abut the coins with the portions having the highest protruding height thereof in the space between the right side lateral protrusion 612*a* and the left side lateral protrusion 613*a*. As a result, a contact area of the housing screw-type conveyance member 62 with respect to the coins may be sufficiently kept. The coin processing apparatus, thus, may successfully convey the coins in the coin container 60*a*.

In the coin processing apparatus, the coins are housed one by one in the pitch intervals of the housing blade member 622 at the front end of the housing screw-type conveyance member 62 in the coin container 60*a*. The coins are ready to be output in a state where they are separated from one another. When the coin output instruction is given, the state makes it possible to dispense a certain number of coins by only rotating the housing screw-type conveyance member 62 in one direction a certain number of times. The coins are simply dispensed in accordance with the coin output instruction without separation and dispensing of the housed coins. The coin processing apparatus, thus, may reduce a time taken to output coins.

In the coin processing apparatus, when the number of coins remaining in the coin container 60*a* is smaller than the reference number, the control unit 100 sets the rotating speed of the corresponding housing motor 65 to be reduced so as to reduce the rotating speed of the housing screw-type conveyance member 62 in one direction. The coin processing apparatus, thus, may successfully convey the coins in the pitch intervals of the housing blade member 622 even when the coins are not housed by being accumulated in the coin container 60*a*.

In the coin processing apparatus, the conveyance mechanism 10 conveys upward the coins received via the coin receiving opening 2 one by one along the certain conveyance path 20*a*, allows the authenticity and the denomination of each coin to be identified by the identification unit 44 during the conveyance of the coin, and sorts the coins identified to be true coins by denomination. The area of the coin processing apparatus, thus, may be more reduced than a coin processing apparatus that conveys the coins using a plurality of belts each endlessly stretched between a pair of rollers. As a result, the coin processing apparatus may be achieved in a compact size.

In the coin processing apparatus, the conveyance section 30 included in the conveyance mechanism 10 is composed of the multiple holding sections 31, which are endlessly connected to one another and each of which may hold a single coin, and is displaced along the rail section forming the conveyance path 20*a*. As a result, the coin processing apparatus may stably convey the coins, and prevent the occurrence of accumulation of coins or a jam of coins during the conveyance.

In the coin processing apparatus, when the coin output command is given, the coins are dispensed from the corresponding coin container 60*a* to the coin output suspending unit 80 while the dispensing opening 80*a*2 is open. The coins dispensed from the coin container 60*a*, thus, may be directly fed to the coin output tray 3 via the dispensing opening 80*a*2. As a result, a time taken to output coins may be reduced. When an abnormality occurs such as a case where the number of coins dispensed from the corresponding coin container 60*a* is larger than the number of coins instructed by the coin output instruction, the dispensing opening 80*a*2 is closed by the dispensing door 84 and the coins dispensed from the coin container 60*a* are fed to the conveyance mechanism 10. Consequently, the coins dispensed extra than the coins the number of which is instructed by the coin output instruction may be collected while the coins insufficient to the coins the number of which is instructed by the coin output instruction may be newly dispensed.

The present disclosure is not limited to the embodiment described above, and may be changed in various ways.

In the embodiment, the setting of the rotating speed is changed on the basis of whether the number of remaining coins is smaller than the reference number in the dispensing control processing. In the present disclosure, a plurality of reference numbers may be set, and the rotating speed of the screw-type conveyance member may be set step-by-step in such a manner that the rotating speed of the screw-type conveyance member is reduced from that at which the number of housed coins is larger than that at present.

In the coin processing apparatus of the present disclosure, the screw-type conveyance member is gradually tilted backward as the blade member protruding upward in the space between the lateral protrusions formed on the housing guide proceeds from one direction to the other direction in the left-right direction in the coin container. The screw-type conveyance member rotates about the central axis of the shaft from one direction to the other direction in the left-right direction and conveys the coins housed in the pitch intervals of the blade member above the lateral protrusions forward. The coin processing apparatus, thus, may prevent the occurrence of the conveyance failure such as a reduction in conveyance force caused by dirt coming from coins in being conveyed or the occurrence of inclined coins. The present disclosure has an advantageous effect of making it possible to prevent the reduction in conveyance force or the occurrence of inclined coins, and to successfully convey the coins.

In the coin processing apparatus of the present disclosure, the screw-type conveyance member is provided at such an off-center position that the screw-type conveyance member is close to one side section in the left-right direction and apart from the other side section in the left-right direction of both side sections of the housing guide. The housing blade member, thus, may abut the coins with the portions having the highest protruding height thereof in the space between the lateral protrusions. As a result, a contact area of the screw-type conveyance member with respect to the coins may be sufficiently kept. The present disclosure has an advantageous effect of making it possible to successfully convey the coins in the coin container.

In the coin processing apparatus of the present disclosure, the screw-type conveyance member has the shaft having a cylindrical shape and the blade member that is spirally provided on the outer periphery of the shaft such that the blade member protrudes outward from the outer periphery. The screw-type conveyance member conveys the coins in the coin container by rotating about the central axis of the shaft. The coin processing apparatus, thus, may prevent the occurrence of a conveyance failure such as the reduction in conveyance force caused by dirt coming from the coins in being conveyed or the occurrence of inclined coins. The present disclosure has an advantageous effect of preventing the reduction in conveyance force and the occurrence of inclined coins, and making it possible to successfully convey the coins.

In the coin processing apparatus of the present disclosure, the control unit controls the rotating speed of the screw-type conveyance member in such a manner that the rotating speed of the screw-type conveyance member is reduced from that at which the number of housed coins is larger than that at present. The present disclosure has an advantageous effect of making it possible to successfully convey the coins in the pitch intervals of the blade member even when the coins are not housed by being accumulated in the coin container.

Although the present disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coin processing apparatus, comprising a plurality of coin containers configured to house received coins for each denomination of the coins and dispense the coins in accordance with a coin output instruction, each of the plurality of coin containers including:

a housing guide that includes:

a case whose upper and lower portions are open, whose longitudinal direction is a front-rear direction, and whose both side sections are paired in a left-right direction; and lateral protrusions formed on inner surfaces of the paired side sections and protruding to extend close to each other; and a screw-type conveyance member that includes:

a shaft having a cylindrical shape and extending along the front-rear direction; and a blade member spirally provided on an outer periphery of the shaft and protruding outward from the outer periphery, wherein the screw-type conveyance member is provided to the housing guide rotatably about a central axis of the shaft, and a part of the shaft and a part of the blade member protrude from a space between the lateral protrusions, and wherein the screw-type conveyance member is configured to gradually tilt backward as the blade member protruding upward from the space between the lateral protrusions proceeds from one direction to the other direction in the left-right direction, and is configured to convey the coins housed in pitch intervals of the blade member above the protrusions forward by rotating about the central axis of the shaft from the one direction to the other direction in the left-right direction, and the screw-type conveyance member is provided at an off-center position such that the screw-type conveyance member is close to one side section in the left-right direction and apart from the other side section in the left-right direction of both side sections of the housing guide.

2. The coin processing apparatus according to claim 1, wherein the screw-type conveyance member houses the coins one by one in the pitch intervals of the blade member at a front end of the screw-type conveyance member.

3. A coin processing apparatus, comprising:

a plurality of coin containers configured to house received coins for each denomination of the coins and dispense the coins in accordance with a coin output instruction, each of the plurality of coin containers including:

a screw-type conveyance member that includes a shaft having a cylindrical shape;

a blade member spirally provided on an outer periphery of the shaft and protruding outward from the outer periphery, wherein the screw type-conveyance member conveys the coins by rotating about a central axis of the shaft; and a reverse roller rotatably supported through a guide above the screw-type conveyance member on a forward side from a central portion of the screw-type conveyance member in a front-rear direction; and a control unit configured to reduce a rotating speed of the screw-type conveyance member when the number of housed coins is less than a predetermined amount.

4. The coin processing apparatus according to claim 3, wherein the screw-type conveyance member houses the coins one by one in pitch intervals of the blade member at a front end of the screw-type conveyance member.

5. The coin processing apparatus according to claim 3, wherein each of the plurality of coin containers further includes a dispensing sensor arranged above the screw-type conveyance member between the reverse roller and a front end of the screw-type conveyance member to detect the coins dispensed forward through rotation of the screw-type conveyance member.

6. The coin processing apparatus according to claim 3, wherein each of the plurality of coin containers further includes a housing guide having a pair of side portions facing each other and lateral protrusions inwardly protruding from the pair of side portions in a direction approaching to each other, wherein the lateral protrusions include a first lateral protrusion portion and a second lateral protrusion portion having a length longer than that of the first lateral protrusion portion such that the screw-type conveyance member is arranged at an off-center position in the front-rear direction to increase a contact area to the coins.

7. The coin processing apparatus according to claim 6, wherein the lateral protrusions are tilted upwardly toward a front end of the housing guide, and the first lateral protrusion portion and the second lateral protrusion portion are formed at height levels same as each other.

* * * * *